US010759625B2

(12) United States Patent
Vogel et al.

(10) Patent No.: US 10,759,625 B2
(45) **Date of Patent: *Sep. 1, 2020**

(54) CORELESS RETAIL PAPER ROLL

(71) Applicant: JENNERJAHN MACHINE, INC., Matthews, IN (US)

(72) Inventors: Roger W. Vogel, Marion, IN (US); Christopher B. Jennerjahn, Hartford City, IN (US); Kristopher M. Kimmerling, Marion, IN (US)

(73) Assignee: JENNERJAHN MACHINE, INC., Matthews, IN (US)

( * ) Notice: Subject to any disclaimer, the term of this patent is extended or adjusted under 35 U.S.C. 154(b) by 282 days.

This patent is subject to a terminal disclaimer.

(21) Appl. No.: 15/925,079

(22) Filed: Mar. 19, 2018

(65) Prior Publication Data

US 2019/0161306 A1 May 30, 2019

Related U.S. Application Data

(60) Provisional application No. 62/591,997, filed on Nov. 29, 2017.

(51) Int. Cl.

| | |
|---|---|
| ***B65H 19/22*** | (2006.01) |
| ***B65H 18/28*** | (2006.01) |
| ***B65H 18/14*** | (2006.01) |
| ***B65H 18/04*** | (2006.01) |
| ***G07G 5/00*** | (2006.01) |

(Continued)

(52) U.S. Cl.

CPC ..... *B65H 19/2276* (2013.01); *B65H 18/04* (2013.01); *B65H 18/145* (2013.01); *B65H 18/28* (2013.01); *B65H 19/30* (2013.01); *G07F 19/201* (2013.01); *G07G 5/00* (2013.01); *B65H 2301/41446* (2013.01); *B65H 2301/41485* (2013.01); *B65H 2301/41891* (2013.01); *B65H 2301/41896* (2013.01); *B65H 2511/12* (2013.01); *B65H 2511/142* (2013.01); *B65H 2701/18422* (2013.01); *B65H 2701/1936* (2013.01); *Y10T 428/28* (2015.01); *Y10T 428/31993* (2015.04)

(58) Field of Classification Search

CPC .. B65H 19/2276; B65H 18/04; B65H 18/145; B65H 2511/12; B65H 2511/14; B65H 2511/142; B65H 2701/18422; B65H 2701/1936; G07G 5/00; Y10T 428/31993; Y10T 428/28

USPC ..... 428/34.1, 34.6, 35.1, 906, 537.5; 242/538.1, 541.2

See application file for complete search history.

(56) References Cited

U.S. PATENT DOCUMENTS

| | | | |
|---|---|---|---|
| 1,977,668 | A | 10/1934 | Dallas |
| 2,486,763 | A | 11/1949 | Roberts |

(Continued)

FOREIGN PATENT DOCUMENTS

| | | | |
|---|---|---|---|
| EP | 0842881 | A2 | 5/1998 |

OTHER PUBLICATIONS

"Western Diazo Coreless Thermal Paper Roll", Amazon.com, Oct. 4, 2018 (Year: 2018).*

(Continued)

*Primary Examiner* — Ruiyun Zhang

(74) *Attorney, Agent, or Firm* — Barnes & Thornburg LLP

(57) ABSTRACT

A paper rewinding machine includes a rewinding assembly operable to produce coreless retail paper rolls.

23 Claims, 21 Drawing Sheets

(51) Int. Cl.
*B65H 19/30* (2006.01)
*G07F 19/00* (2006.01)

(56) References Cited

U.S. PATENT DOCUMENTS

| | | | |
|---|---|---|---|
| 2,621,867 | A | 12/1952 | Grettve |
| 2,711,863 | A | 6/1955 | Grettve |
| 2,747,809 | A | 5/1956 | William |
| 2,772,838 | A | 12/1956 | Lenz |
| 2,890,001 | A | 6/1959 | Triquet |
| 3,223,341 | A | 12/1965 | Gadde |
| 3,596,847 | A | 8/1971 | Peterson |
| 3,718,302 | A | 2/1973 | Mount et al. |
| 3,834,257 | A | 9/1974 | Ganser |
| 3,904,143 | A | 9/1975 | Kullander |
| 3,904,144 | A | 9/1975 | Gattrugeri |
| 3,908,926 | A | 9/1975 | Ochs et al. |
| 4,135,677 | A | 1/1979 | Warczak |
| 4,195,792 | A | 4/1980 | Hall |
| 4,695,005 | A | 9/1987 | Gietman, Jr. |
| 4,944,468 | A | 7/1990 | Damour |
| 5,054,756 | A | 10/1991 | Riemscheid et al. |
| 5,136,833 | A | 8/1992 | Inger |
| 5,271,137 | A | 12/1993 | Schutz |
| 5,453,070 | A | 9/1995 | Moody |
| 5,497,959 | A | 3/1996 | Johnson et al. |
| 5,499,780 | A | 3/1996 | Gensheimer |
| 5,797,559 | A | 8/1998 | Coffey |
| 6,015,154 | A | 1/2000 | Andre et al. |
| 6,102,313 | A | 8/2000 | Salzsauler et al. |
| 6,367,733 | B1 | 4/2002 | McLaughlin |
| 2007/0152094 | A1 | 7/2007 | Deacon |

OTHER PUBLICATIONS

"Thermal Printer Paper Roll Specifications", Pandapaperroll.com, Oct. 4, 2018 (Year: 2018).*

International Search Report, International Application No. PCT/US2018/062573, dated Mar. 5, 2019, 18 pages.

* cited by examiner

CORELESS RETAIL PAPER ROLL

This application claims priority under 35 U.S.C. § 119 to U.S. Provisional Patent Application Ser. No. 62/591,997 which was filed on Nov. 29, 2017 and is hereby incorporated herein by reference.

CROSS-REFERENCE

Cross reference is also made to copending U.S. patent application Ser. No. 15/925,049 entitled "PAPER REWINDING MACHINE HAVING A HYDRAULIC EXTRACTOR"; copending U.S. patent application Ser. No. 15/925,056 entitled "PAPER REWINDING MACHINE HAVING AN EXTRACTION ASSEMBLY FOR EXTRACTING A CORELESS RETAIL PAPER ROLL"; copending U.S. patent application Ser. No. 15/925,025 entitled "METHOD OF MAKING A CORELESS RETAIL PAPER ROLL"; copending U.S. patent application Ser. No. 15/925,069 entitled "CORELESS RETAIL PAPER ROLL"; and copending U.S. patent application Ser. No. 15/925,074 entitled "CORELESS RETAIL PAPER ROLL", each of which is assigned to the same assignee as the present application, each of which is filed concurrently herewith, and each of which is hereby incorporated by reference.

TECHNICAL FIELD

The present disclosure relates generally to paper rewinding machines and more particularly to paper rewinding machines operable to produce coreless retail paper rolls.

BACKGROUND

Rewinding machines create rolls of retail paper such as point-of-sale (POS) receipts, ATM receipts, lottery tickets, and the like. These rewinding machines traditionally form retail paper rolls on a disposable core such as a plastic or cardboard tube. This core adds to the material cost of the retail paper rolls and the environmental waste associated with disposing them after use of the retail paper roll.

For over a decade attempts have been made to produce coreless retail paper rolls. Such attempts have been met with mixed results. The primary challenge has been that coreless retail paper rolls lack the rigidity or hardness of cored rolls. Specifically, heretofore designed coreless retail paper rolls are "squishy" and easily deform during handling such as shipping of the rolls to a customer. Squished or otherwise deformed rolls do not operate effectively in the retailer's printer.

Because of these issues, only coreless retail paper rolls with relatively small inner diameters have enjoyed much, if any, commercial success. Such rolls are manufactured in manual or semi-automatic settings at relatively slow machine throughput speeds. Moreover, because of their small inner diameters, correspondingly small rewind arbors are needed to produce them. Because the bed rollers used to support these small rewind arbors deflect substantially across long lengths, only relatively short bed rollers and rewind arbors (and hence relatively short incoming paper web widths) can be used. These limitations combine to create a relatively slow and small-volume production operation that is labor intensive. As such, only fairly small batches of relatively small coreless retail paper rolls are produced using current commercially-utilized techniques. Moreover, the coreless retail paper rolls produced by such current techniques are still unacceptably squishy for most high-volume end users. That, coupled with the fact the rolls themselves are small (and as a result require frequent change over), has prevented coreless retail paper rolls from being used in high-volume applications such as large retail stores and grocery stores.

SUMMARY

According to one aspect of the disclosure, a paper rewinding machine for producing retail paper rolls includes a pair of bed rollers and a rewind arbor supported by the pair of bed rollers such that retail paper is wound around the rewind arbor during rotation of the pair of bed rollers. The rewinding machine also includes a hydraulic actuator operable to extract the rewind arbor from the wound retail paper.

In an embodiment, the paper rewinding machine also includes a clamping mechanism that is operable to retain an end of the rewind arbor during operation of the hydraulic actuator.

The hydraulic actuator may be embodied as a hydraulic cylinder having a rod in which actuation of the hydraulic cylinder causes movement of its rod thereby extracting the rewind arbor from the wound retail paper. In such an embodiment, actuation of the hydraulic cylinder may cause extension of its rod.

The paper rewinding machine may also include a slitting assembly operable to slit the retail paper prior to winding the retail paper on the rewind arbor into a plurality of retail paper rolls. In such a case, the hydraulic actuator is operable to extract the rewind arbor from the plurality of retail paper rolls.

The paper rewinding machine may also include a collection trough positioned so as to receive the plurality of retail paper rolls during operation of the hydraulic actuator.

The paper rewinding machine may also include a collection conveyor. In such an embodiment, the collection trough may be pivotable between a collection position and a dump position such that the plurality of retail paper rolls are transferred from the collection trough to the collection conveyor during movement of the collection trough from the collection position to the dump position.

According to another aspect, a paper rewinding machine for producing retail paper rolls includes a slitting assembly operable to slit retail paper, a pair of bed rollers positioned to receive retail paper exiting the slitting assembly, and a rewind arbor supported by the pair of bed rollers such that slit retail paper is wound into a plurality of retail paper rolls around the rewind arbor during rotation of the pair of bed rollers. The paper rewinding machine may also include a hydraulic cylinder operable to extract the rewind arbor from the plurality of retail paper rolls.

The hydraulic actuator may be embodied as a hydraulic cylinder having a rod in which actuation of the hydraulic cylinder causes movement of its rod thereby extracting the rewind arbor secured thereto from the wound retail paper. In such an embodiment, actuation of the hydraulic cylinder may cause extension of its rod.

The paper rewinding machine may also include a slitting assembly operable to slit the retail paper prior to winding the retail paper on the rewind arbor into a plurality of retail paper rolls. In such a case, the hydraulic actuator is operable to extract the rewind arbor from the plurality of retail paper rolls.

The paper rewinding machine may also include a collection trough positioned so as to receive the plurality of retail paper rolls during operation of the hydraulic actuator.

The paper rewinding machine may also include a collection conveyor. In such an embodiment, the collection trough may be pivotable between a collection position and a dump position such that the plurality of retail paper rolls are transferred from the collection trough to the collection conveyor during movement of the collection trough from the collection position to the dump position.

According to yet another aspect, a method of operating a paper rewinding machine includes slitting retail paper and advancing the slit retail paper into contact with a pair of bed rollers. Thereafter, the pair of bed rollers are rotated so as to wind the slit retail paper around a rewind arbor thereby producing a plurality of retail paper rolls. A hydraulic actuator is operated to extract the rewind arbor from the plurality of retail paper rolls.

The hydraulic actuator may be embodied as a hydraulic cylinder. In such an arrangement, an end of the rewind arbor may be retained during movement of the cylinder's rod so as to extract the rewind arbor from the plurality of retail paper rolls. The rewind arbor may be extracted by extension of the cylinder's rod.

The method may also include collecting the plurality of retail paper rolls in a collection trough during operation of the hydraulic actuator. Thereafter, the plurality of retail paper rolls may be transferred from the collection trough to a collection conveyor by pivoting the collection trough to dump the plurality of retail paper rolls out of the collection trough and onto the collection conveyor.

According to another aspect, a paper rewinding machine for producing retail paper rolls includes a slitting assembly operable to slit retail paper, a pair of bed rollers positioned to receive retail paper exiting the slitting assembly, and a rewind arbor supported by the pair of bed rollers such that slit retail paper is wound into a plurality of retail paper rolls around the rewind arbor during rotation of the pair of bed rollers. The paper rewinding machine may also include an extraction assembly operable to generate an extraction force of at least 10 lbs/in so as to extract the rewind arbor from the plurality of retail paper rolls.

In an embodiment, the extraction assembly is operable to generate an extraction force of at least 17 lbs/in so as to extract the rewind arbor from the plurality of retail paper rolls.

In another embodiment, the extraction assembly is operable to generate an extraction force of at least 24 lbs/in so as to extract the rewind arbor from the plurality of retail paper rolls.

In yet another embodiment, the extraction assembly is operable to generate an extraction force of at least 32 lbs/in so as to extract the rewind arbor from the plurality of retail paper rolls.

In another embodiment, the extraction assembly may be embodied as a hydraulic cylinder, a pneumatic cylinder, a rack and pinion assembly, a driven chain and carriage assembly, a driven belt and carriage assembly, a ball screw and carriage assembly, a lever arm assembly, or a winch assembly.

The paper rewinding machine may also include a collection trough positioned so as to receive the plurality of retail paper rolls during operation of the extraction assembly.

The paper rewinding machine may also include a collection conveyor. In such an embodiment, the collection trough may be pivotable between a collection position and a dump position such that the plurality of retail paper rolls are transferred from the collection trough to the collection conveyor during movement of the collection trough from the collection position to the dump position.

According to yet another aspect, a method of operating a paper rewinding machine includes slitting retail paper and advancing the slit retail paper into contact with a pair of bed rollers. Thereafter, the pair of bed rollers are rotated so as to wind the slit retail paper around a rewind arbor thereby producing a plurality of retail paper rolls. An extraction assembly is operated to generate an extraction force of at least 10 lbs/in so as to extract the rewind arbor from the plurality of retail paper rolls.

In an embodiment, the extraction assembly is operated to generate an extraction force of at least 17 lbs/in so as to extract the rewind arbor from the plurality of retail paper rolls.

In another embodiment, the extraction assembly is operated to generate an extraction force of at least 24 lbs/in so as to extract the rewind arbor from the plurality of retail paper rolls.

In yet another embodiment, the extraction assembly is operated to generate an extraction force of at least 32 lbs/in so as to extract the rewind arbor from the plurality of retail paper rolls.

The method may also include collecting the plurality of retail paper rolls in a collection trough during operation of the extraction assembly. Thereafter, the plurality of retail paper rolls may be transferred from the collection trough to a collection conveyor by pivoting the collection trough to dump the plurality of retail paper rolls out of the collection trough and onto the collection conveyor.

According to another aspect, a method of operating a paper rewinding machine includes positioning retail paper on a first bed roller and a second bed roller and thereafter positioning a rewind arbor on the retail paper such that the rewind arbor is supported by the first bed roller and the second bed roller. The method also includes rotating the first bed roller and the second bed roller so as to rotate the rewind arbor thereby winding retail paper around the rewind arbor. During such rotation, the second bed roller may be rotated at a speed that is greater than 3% faster than the speed of the first bed roller.

The rewind arbor may be positioned in direct contact with the retail paper so as to produce a coreless retail paper rolls.

In an embodiment, the second bed roller is rotated at a speed that is at least 3.75% faster than the speed of the first bed roller. In another embodiment, the second bed roller is rotated at a speed that is at least 4.5% faster than the speed of the first bed roller.

In an embodiment, the method also includes positioning a rider roller in contact with the retail paper being wound on the rewind arbor, and applying a torque on the rider roller that produces a tangential force of at least 1.1 lbs/in on the surface of the retail paper being wound on the rewind arbor. In an embodiment, the rider roller produces a tangential force of at least 1.4 lbs/in on the surface of the retail paper being wound on the rewind arbor. In another embodiment, the rider roller produces a tangential force of at least 1.7 lbs/in on the surface of the retail paper being wound on the rewind arbor.

In another embodiment, the method also includes urging the rider roller in the direction of the rewind arbor so as to apply a pack force of at least 6.0 lbs/in on the retail paper being wound on the rewind arbor. In an embodiment, a pack force of at least 8.0 lbs/in is applied on the retail paper being wound on the rewind arbor. In another embodiment, a pack force of at least 10.0 lbs/in is applied on the retail paper being wound on the rewind arbor.

According to another aspect, a method of operating a paper rewinding machine includes positioning retail paper on a first bed roller and a second bed roller, positioning a rewind arbor on the retail paper such that the rewind arbor is supported by the first bed roller and the second bed roller, and rotating the first bed roller and the second bed roller so as to rotate the rewind arbor thereby winding retail paper around the rewind arbor. The method also includes rotating a rider roller in contact with the retail paper being wound on the rewind arbor. During rotation of the rider roller, a torque is applied thereto so as to produce a tangential force of at least 1.1 lbs/in on the surface of the retail paper being wound on the rewind arbor.

In an embodiment, the rider roller produces a tangential force of at least 1.4 lbs/in on the surface of the retail paper being wound on the rewind arbor. In another embodiment, the rider roller produces a tangential force of at least 1.7 lbs/in on the surface of the retail paper being wound on the rewind arbor.

In an embodiment, the method may also include urging the rider roller in the direction of the rewind arbor so as to apply a pack force of at least 6.0 lbs/in on the retail paper being wound on the rewind arbor. In an embodiment, a pack force of at least 8.0 lbs/in is applied on the retail paper being wound on the rewind arbor. In yet another embodiment, a pack force of at least 10.0 lbs/in is applied on the retail paper being wound on the rewind arbor.

In an embodiment, the second bed roller is rotated at a speed that is at least 3% faster than the speed of the first bed roller. In another embodiment, the second bed roller is rotated at a speed that is at least 3.75% faster than the speed of the first bed roller. In another embodiment, the second bed roller is rotated at a speed that is at least 4.5% faster than the speed of the first bed roller.

The rewind arbor may be positioned in direct contact with the retail paper so as to produce a coreless retail paper rolls.

According to another aspect, a method of operating a paper rewinding machine includes positioning retail paper on a first bed roller and a second bed roller, positioning a rewind arbor on the retail paper such that the rewind arbor is supported by the first bed roller and the second bed roller, and rotating the first bed roller and the second bed roller so as to rotate the rewind arbor thereby winding retail paper around the rewind arbor. The method also includes rotating a rider roller in contact with the retail paper being wound on the rewind arbor. The method further includes urging the rider roller in the direction of the rewind arbor so as to apply a pack force of at least 6.0 lbs/in on the retail paper being wound on the rewind arbor.

In an embodiment, a pack force of at least 8.0 lbs/in is applied on the retail paper being wound on the rewind arbor. In yet another embodiment, a pack force of at least 10.0 lbs/in is applied on the retail paper being wound on the rewind arbor.

In another embodiment, during rotation of the rider roller a torque is applied thereto so as to produce a tangential force of at least 1.1 lbs/in on the surface of the retail paper being wound on the rewind arbor. In an embodiment, the rider roller produces a tangential force of at least 1.4 lbs/in on the surface of the retail paper being wound on the rewind arbor. In another embodiment, the rider roller produces a tangential force of at least 1.7 lbs/in on the surface of the retail paper being wound on the rewind arbor.

In an embodiment, the second bed roller is rotated at a speed that is at least 3% faster than the speed of the first bed roller. In another embodiment, the second bed roller is rotated at a speed that is at least 3.75% faster than the speed of the first bed roller. In another embodiment, the second bed roller is rotated at a speed that is at least 4.5% faster than the speed of the first bed roller.

The rewind arbor may be positioned in direct contact with the retail paper so as to produce a coreless retail paper rolls.

According to yet another aspect, a method of operating a paper rewinding machine includes positioning retail paper on a first bed roller and a second bed roller, positioning a rewind arbor on the retail paper such that the rewind arbor is supported by the first bed roller and the second bed roller, and rotating the first bed roller and the second bed roller so as to rotate the rewind arbor thereby winding retail paper around the rewind arbor. The second bed roller may be rotated at a speed that is 3.1-4.5% faster than the speed of the first bed roller. The method also includes rotating a rider roller in contact with the retail paper being wound on the rewind arbor. During rotation of the rider roller a torque may be applied thereto so as to produce a tangential force of 1.1-1.7 lbs/in on the surface of the retail paper being wound on the rewind arbor. The method may also include urging the rider roller in the direction of the rewind arbor so as to apply a pack force of 6.0-10.0 lbs/in on the retail paper being wound on the rewind arbor.

The rewind arbor may be positioned in direct contact with the retail paper so as to produce a coreless retail paper rolls.

According to another aspect, a coreless retail paper roll has a width of 4 inches or less, an outer diameter range of about 1 inch to about 4 inches, and a central hole having an inner diameter range of about 0.4 inches to about 0.5 inches, and an Rc of 350 pounds/inch/inch or greater when a force greater than about 7 pounds/inch is applied to the coreless retail paper roll.

In an embodiment, the coreless retail paper roll has an Rc of 350 pounds/inch/inch or greater when a force greater than about 10 pounds/inch is applied to the coreless retail paper roll.

The coreless retail paper roll may have an outer diameter range of about 1 to about 1.7 inches and an Rc of 450 pounds/inch/inch or greater.

In an embodiment, the coreless retail paper roll has outer diameter range of about 1.7 inches to about 2.2 inches and an Rc of 450 pounds/inch/inch or greater.

In another embodiment, the coreless retail paper roll has outer diameter range of about 2.2 inches to about 4 inches and an Rc of 450 pounds/inch/inch or greater.

According to another aspect, a coreless paper roll has a width of 4 inches or less, an outer diameter range of about 1.5 inch to about 4 inches, a central hole having an inner diameter range of about 0.5 inches to about 0.9 inches, and an Rc of 350 pounds/inch/inch or greater when a force greater than about 7 pounds/inch is applied to the coreless retail paper roll.

In an embodiment, the coreless retail paper roll has an Rc of 350 pounds/inch/inch or greater when a force greater than about 10 pounds/inch is applied to the coreless retail paper roll.

In another embodiment, the coreless retail paper roll has outer diameter range of about 1.5 to about 2 inches and an Rc of 450 pounds/inch/inch or greater.

In yet another embodiment, the coreless retail paper roll has outer diameter range of about 2 inches to about 2.5 inches and an Rc of 450 pounds/inch/inch or greater.

In another embodiment, the coreless retail paper roll has outer diameter range of about 2.5 inches to about 4 inches and an Rc of 450 pounds/inch/inch or greater.

According to yet another aspect, a coreless retail paper roll has a width of 4 inches or less, an outer diameter range of about 1.7 inch to about 4 inches, a central hole having an inner diameter range of about 0.8 inches to about 1.2 inch, and an Rc of 350 pounds/inch/inch or greater when a force greater than about 7 pounds/inch is applied to the coreless retail paper roll.

In an embodiment, the coreless retail paper roll has an Rc of 350 pounds/inch/inch or greater when a force greater than about 10 pounds/inch is applied to the coreless retail paper roll.

In another embodiment, the coreless retail paper roll has outer diameter range of about 1.7 to about 2.2 inches and an Rc of 450 pounds/inch/inch or greater.

In yet another embodiment, the coreless retail paper roll has outer diameter range of about 2.2 inches to about 2.6 inches and an Rc of 450 pounds/inch/inch or greater.

In another embodiment, the coreless retail paper roll has outer diameter range of about 2.6 inches to about 4 inches and an Rc of 450 pounds/inch/inch or greater.

BRIEF DESCRIPTION OF THE DRAWINGS

The detailed description particularly refers to the following figures, in which.

DETAILED DESCRIPTION OF THE DRAWINGS

Figure 1:
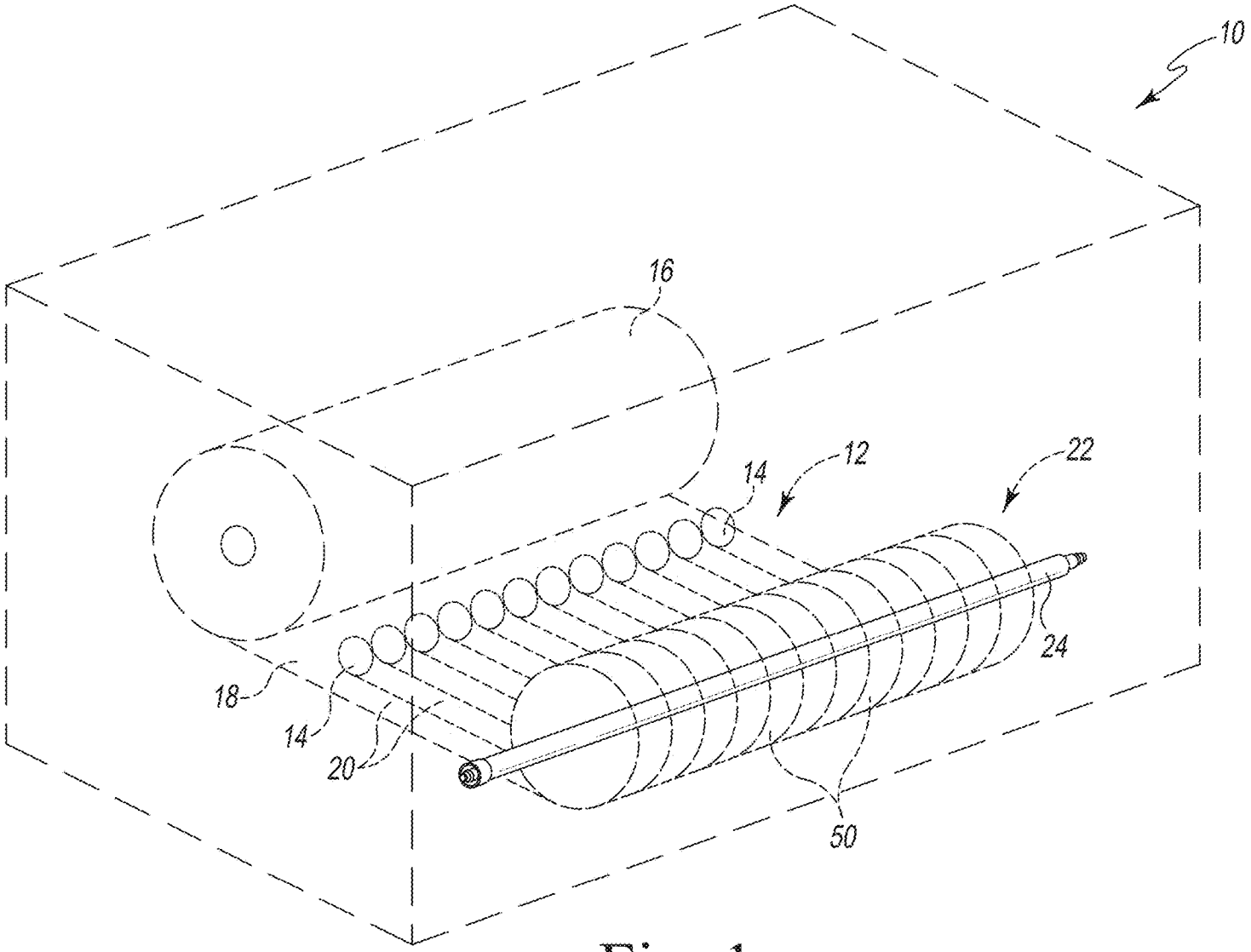
FIG. 1 is a diagrammatic view of a paper winding machine that is operable to produce coreless retail paper rolls.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, there is shown a paper rewinding machine 10. As will be discussed in more detail herein, the paper rewinding machine 10 is operable to convert a relatively large supply roll of retail paper into smaller coreless retail paper rolls. What is meant herein by the term "retail paper" is either thermal paper or bond paper commercially used in the retail industry for printable documents such as point-of-sale (POS) receipts, ATM receipts, lottery tickets, and the like. The weights of such retail paper can vary from 30 grams/square meter (gsm) (for fairly lightweight POS receipts) to as high as 260 gsm (for heavier uses such as lottery, game, bus, or movie tickets). More generally, however, the weights of retail paper used in the retail industry for printable documents varies from 30-100 gsm with typical POS applications utilizing retail paper having a weight in the range of 42-82 gsm. Along the same line, what is meant herein by the term "retail paper roll" is a roll of retail paper 100 mm or less in width thereby being usable in point-of-sale (POS) printers, ATM printers, lottery machine printers, and the like. As used herein, the term "coreless retail paper roll" is a retail paper roll that does not include a structurally-supporting core such as a cardboard or plastic tube.

The paper rewinding machine 10 includes a slitting assembly 12 having a number of rotary knives 14. A large supply roll 16 of retail paper unwinds as a stock sheet 18 of retail paper that is advanced through the knives 14 of the slitting assembly. The knives 14 cut the stock sheet 18 of retail paper into a number of slit sheets 20 of retail paper. The position of the knives 14 of the slitting assembly 12 are adjustable to produce slit sheets 20 in various desired widths. In an illustrative embodiment, the supply roll 16 and hence the stock sheet 18 may be 600-1600 mm wide, whereas the individual slit sheets 20 may be 25-100 mm in width.

As can be seen diagrammatically in FIG. 1 (and in more detail in FIGS. 2-7), the paper rewinding machine 10 also includes a winding assembly 22. As will be discussed in more detail below, the winding assembly 22 includes a number of rollers which cooperate to wind the slit sheets 20 exiting the slitting assembly 12 around a rewind arbor 24 to form a plurality of individual coreless retail paper rolls 50. The paper rewinding machine 10 stops winding the coreless retail paper rolls 50 when a suitable diameter is obtained (and hence each of the coreless retail paper rolls 50 has a desired length of retail paper). The finished coreless retail paper rolls 50 are then sealed using glue or adhesive labels. As will also be discussed in more detail below, the rewind arbor 24 may then be extracted from the coreless retail paper rolls 50 by use of a hydraulic actuator. The rolls are discharged from the winding machine 10 using a conveyor belt.

The paper rewinding machine 10 may be operated in a fully automatic mode in which an operator is not needed. In such a mode, the paper rewinding machine 10 can produce coreless retail paper rolls 50 at speeds up to 2,300 fpm.

Figure 2:
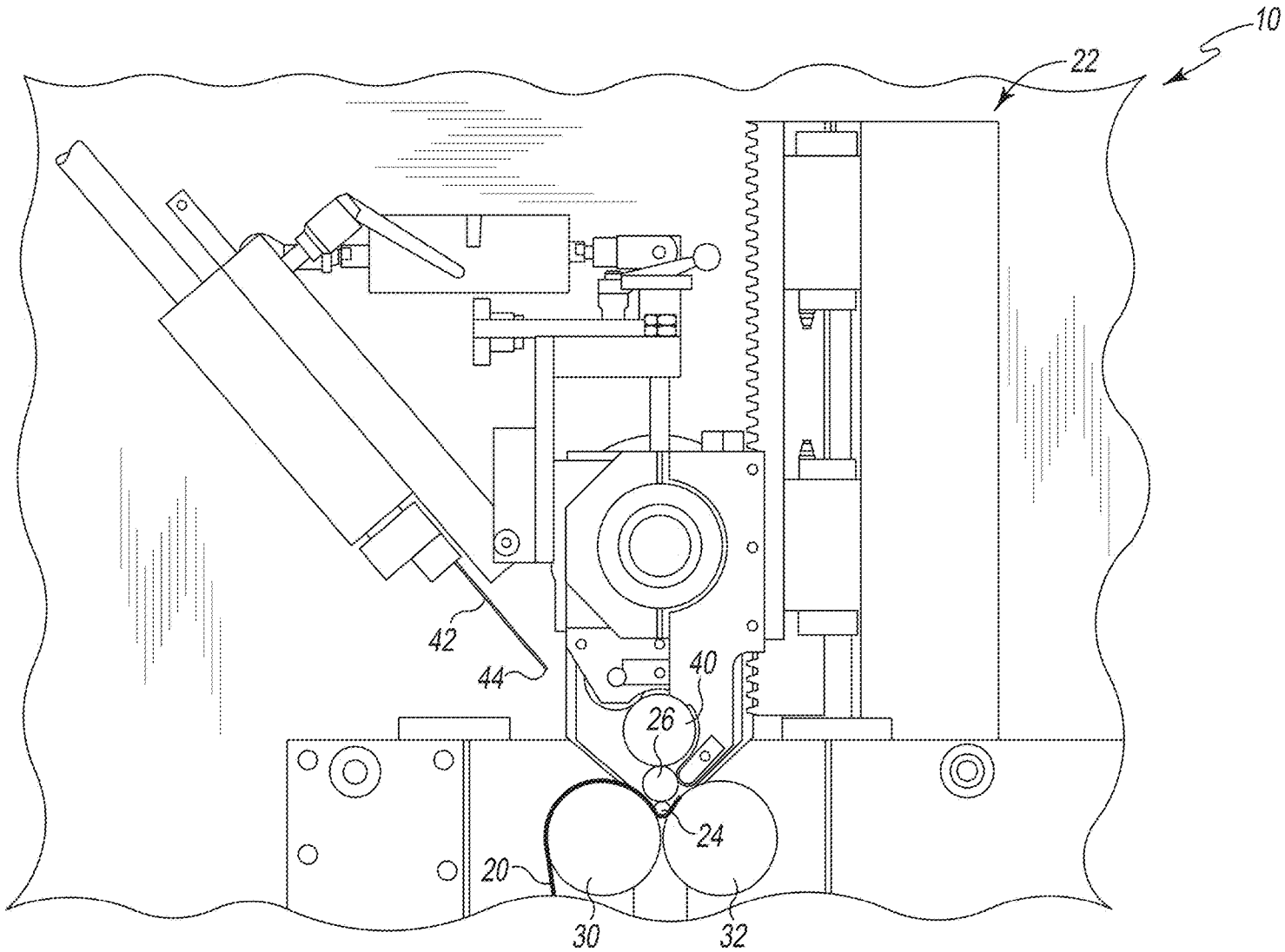
FIG. 2 is a fragmentary side elevation view of the winding assembly of the paper winding machine of FIG. 1.

Referring now to FIGS. 2-7, operation of the winding assembly 22 is shown in more detail. As can be seen in FIG. 2, the winding assembly 22 includes a pair of bed rollers 30, 32. The slit sheets 20 exiting the slitting assembly 12 are advanced into the winding assembly 22 such that the sheets 20 are wrapped around the front bed roller 30 and thereafter lay on top of the rear bed roller 32. One of the rewind arbors 24 is then positioned on the slit sheets 20 of retail paper. As can be seen in FIG. 2, when so positioned, the rewind arbor 24 rests on top of and in between the front bed roller 30 and the rear bed roller 32 with the slit sheets 20 of retail paper sandwiched therebetween. It should be appreciated that in such an arrangement, the rewind arbor 24 rests in direct contact with the sheets 20 of retail paper since the rolls being produced are coreless retail paper rolls. In other words, unlike production of cored rolls in which the retail paper is positioned in contact with the cores installed on the rewind arbor, in the case of production of the coreless retail paper rolls described herein, the outer surface of the rewind arbor 24 is positioned in direct contact with the sheets 20 of retail paper.

Figure 3:
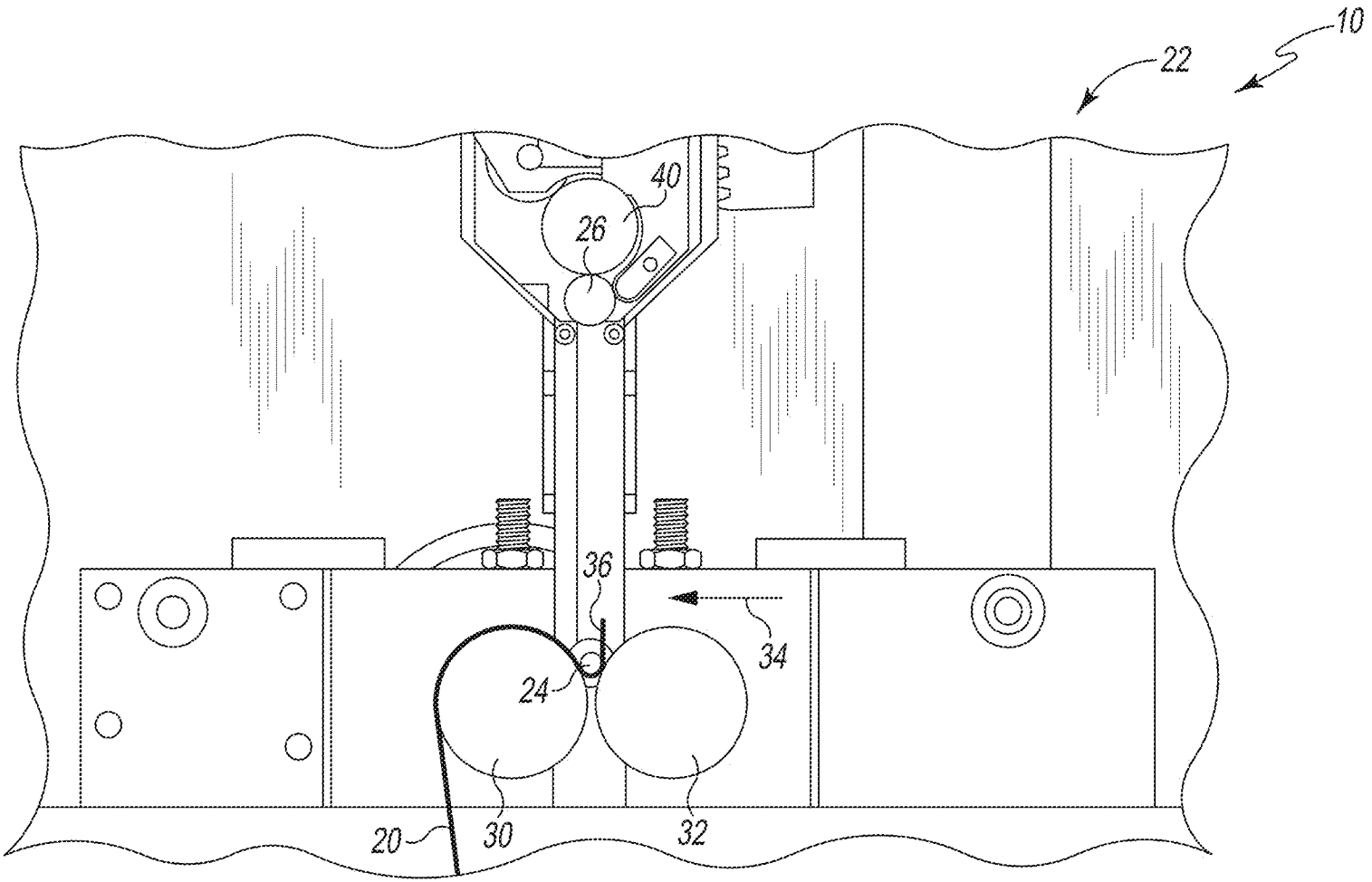
FIG. 3 is an enlarged view similar to FIG. 2 showing the tail of the retail paper sheet being positioned on the winding arbor by an air blast.
Figure 4:
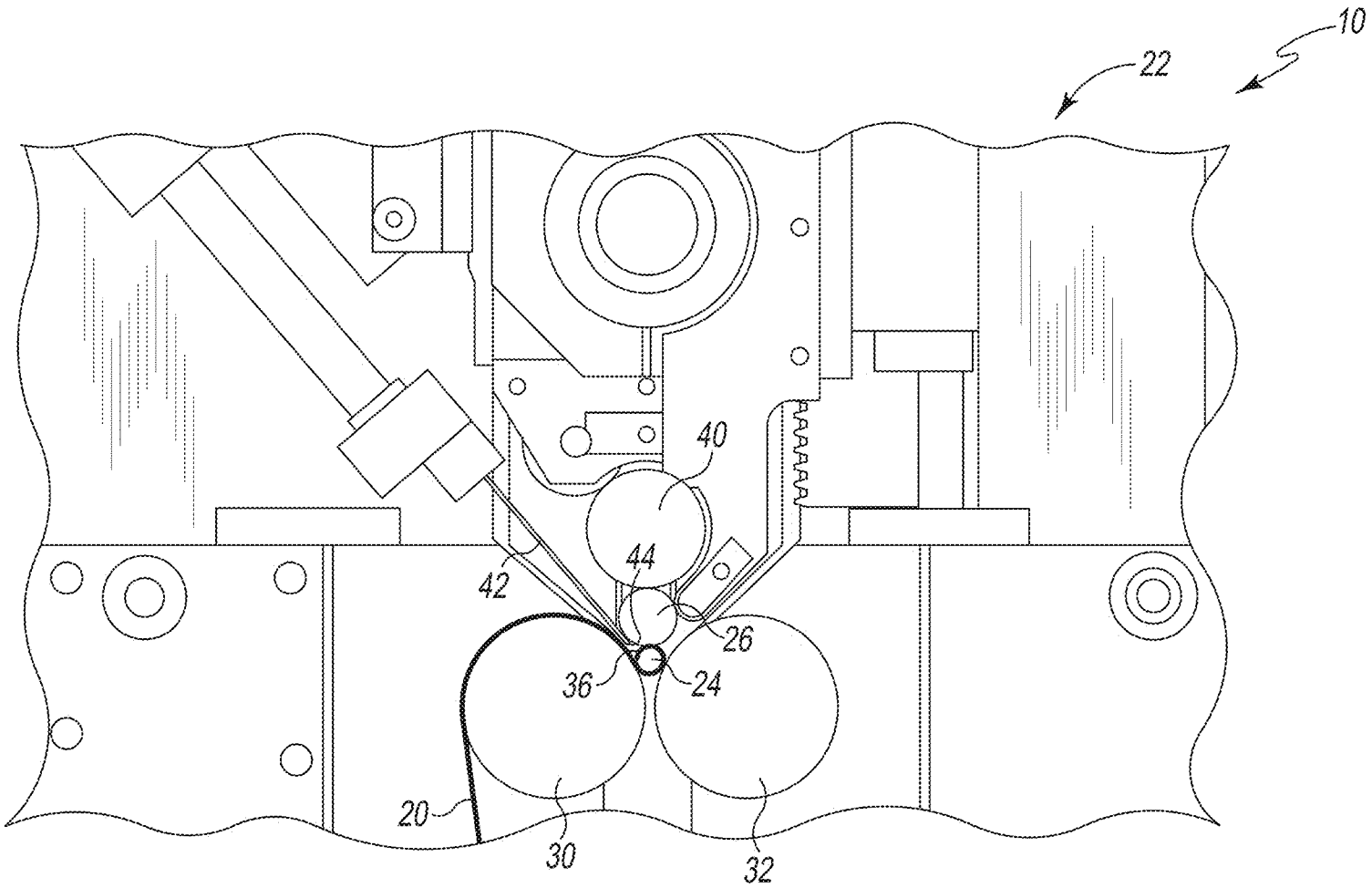
FIG. 4 is a view similar to FIG. 3, but showing operation of the tuck blade of the winding assembly.

As shown in FIG. 3, an air blast (shown diagrammatically by arrow 34) from a compressed air nozzle (not shown) is directed on the slit sheets 20 of retail paper so as to wrap the tails 36 of the sheets 20 of retail paper that were resting on the rear bed roller 32 around the rewind arbor 24. A pair of pack cylinders 38 (see FIG. 7) then retract such that a primary rider roller 40 and a secondary rider roller 26 (if one is being used as described below) are lowered down and rest on top of the rewind arbor 24 and hence the tails 36 of the sheets 20 of retail paper positioned on the rewind arbor 24. As shown in FIG. 4, a tail tuck blade 42 then extends towards the rewind arbor 24 such that its tip 44 pushes the tails 36 of the sheets 20 of retail paper in between the rewind arbor 24 and front bed roller 30.

Figure 5:
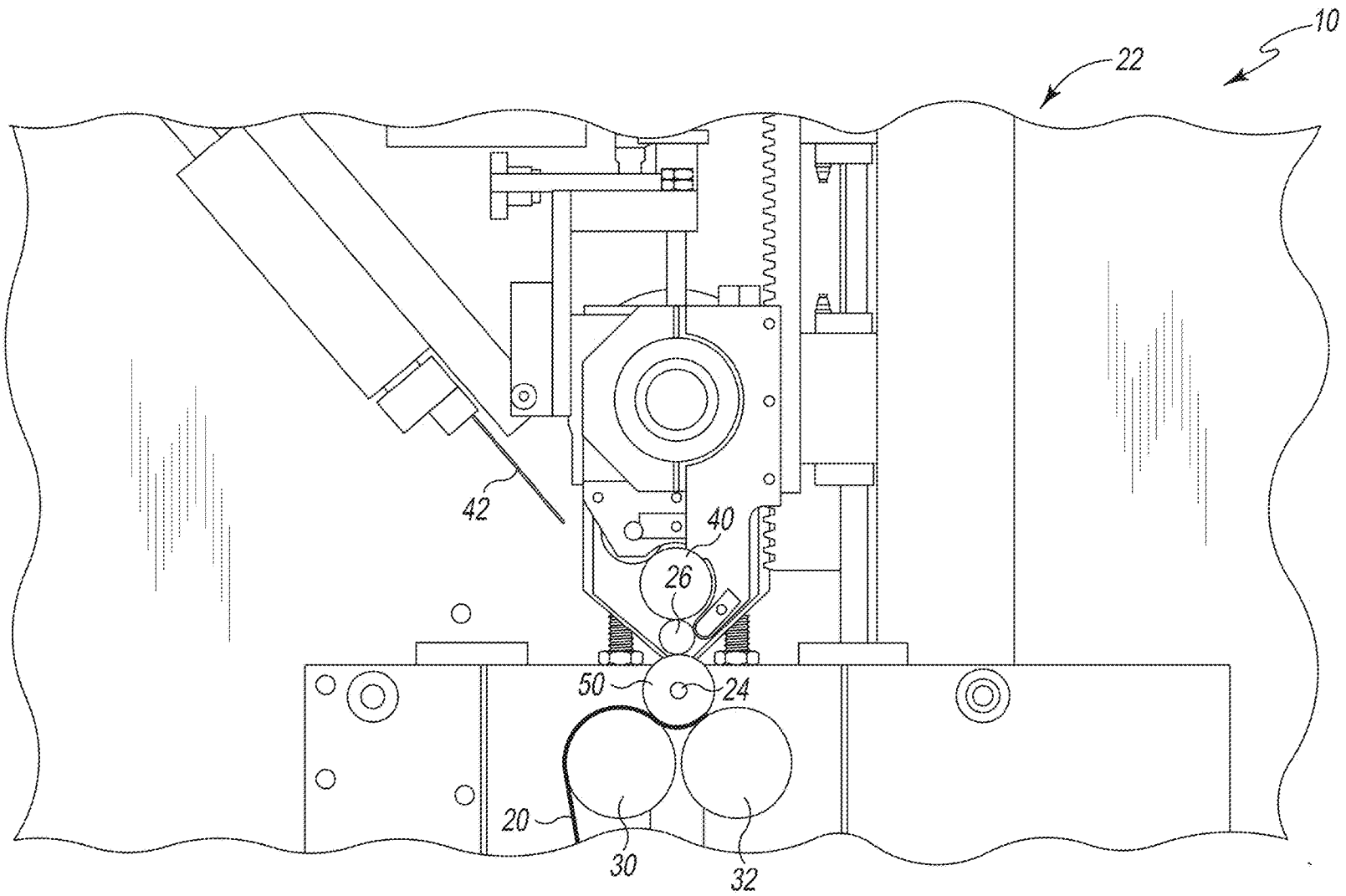
FIG. 5 is a view similar to FIG. 4, but showing the coreless retail paper being wound around the rewind arbor.

As shown in FIG. 5, the bed rollers 30, 32 then begin to rotate. Rotation of the bed rollers 30, 32 advances the sheets 20 of retail paper and rotates the rewind arbor 24. The sheets 20 of retail paper are wound around the rewind arbor 24 to produce coreless retail paper rolls 50 of a specific diameter or a specific length. Once coreless retail paper rolls 50 of the desired size have been wound, rotation of the bed rollers 30, 32 is halted. The bed rollers 30, 32 are then locked in position while the rider rollers 26, 40 are rotated in a reverse direction. This kicks the finished coreless retail paper rolls 50 (and hence the rewind arbor 24 around which they are wound) out of the bed rollers 30, 32 and transports them to the rear of the winding machine 10. The trailing end of the sheets 20 of retail paper is then cut by a rotary knife (not shown) and rear tails of the finished coreless retail paper rolls 50 are sealed to the roll.

Figure 8:
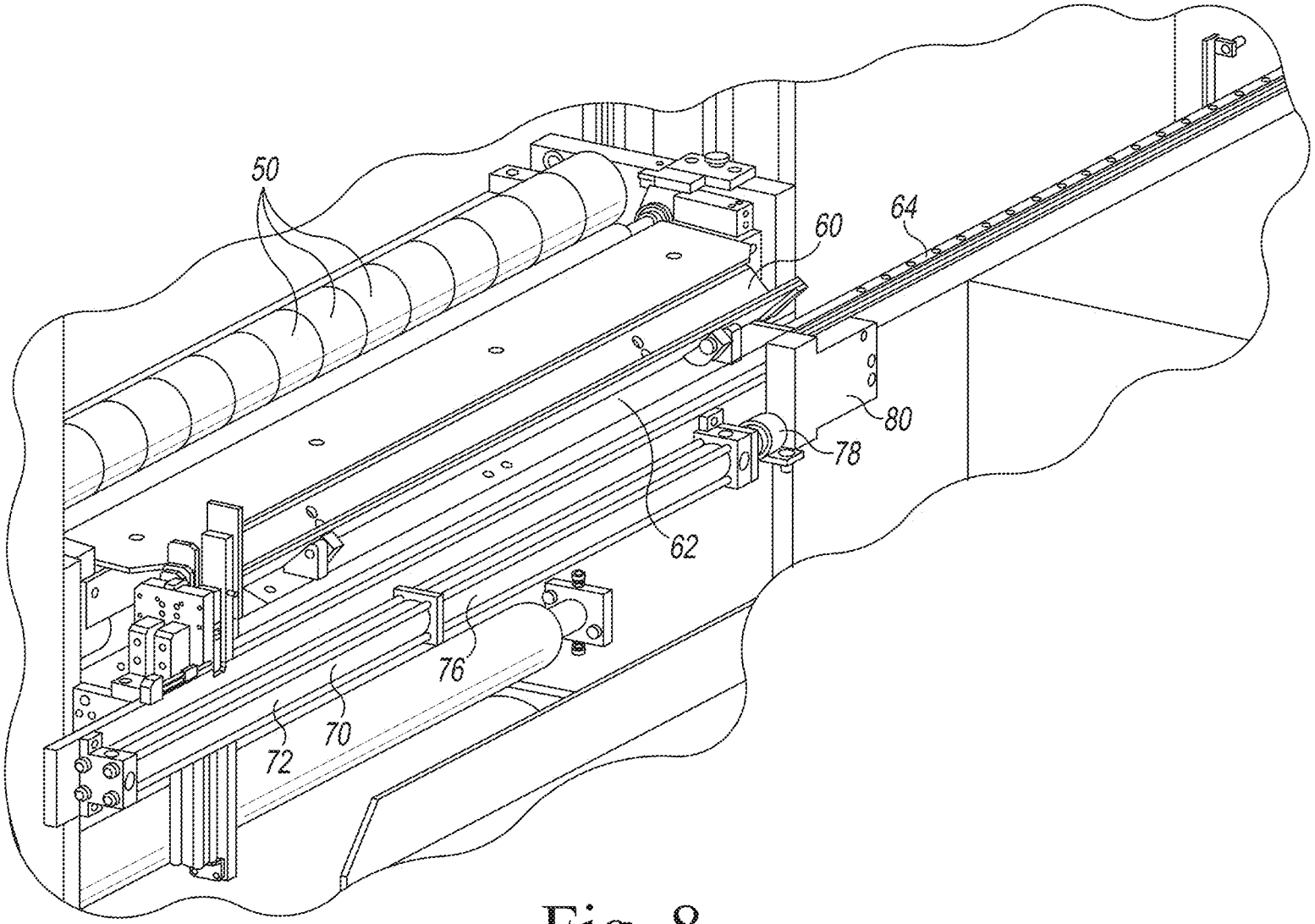
FIGS. 8-11 are fragmentary side elevational views of the hydraulic extraction assembly of the paper winding machine of FIG. 1, note that for clarity of description the collection conveyor has (a) been removed from FIGS. 8-10, and (b) is shown in phantom in FIG. 11.

As can be seen in FIGS. 8-11, the finished coreless retail paper rolls 50 (and hence the rewind arbor 24 around which they are wound) are advanced to the rear of the coreless rewinding machine 10 and into a V-shaped collection trough 60. The collection trough 60 is pivotally coupled to a carriage 62. The carriage 62 slides or otherwise translates back and forth along a rail 64. Specifically, as can be seen in FIG. 8, the carriage 62 (and hence the collection trough 60) is movable between a collection position in which the collection trough 60 is positioned to collect finished coreless retail paper rolls 50 (and hence the rewind arbor 24 around which they are wound) exiting the winding assembly 22 and a transfer position (see FIG. 11) in which the collection trough 60 is positioned to transfer the rolls 50 to a collection conveyor 66.

Figure 11:
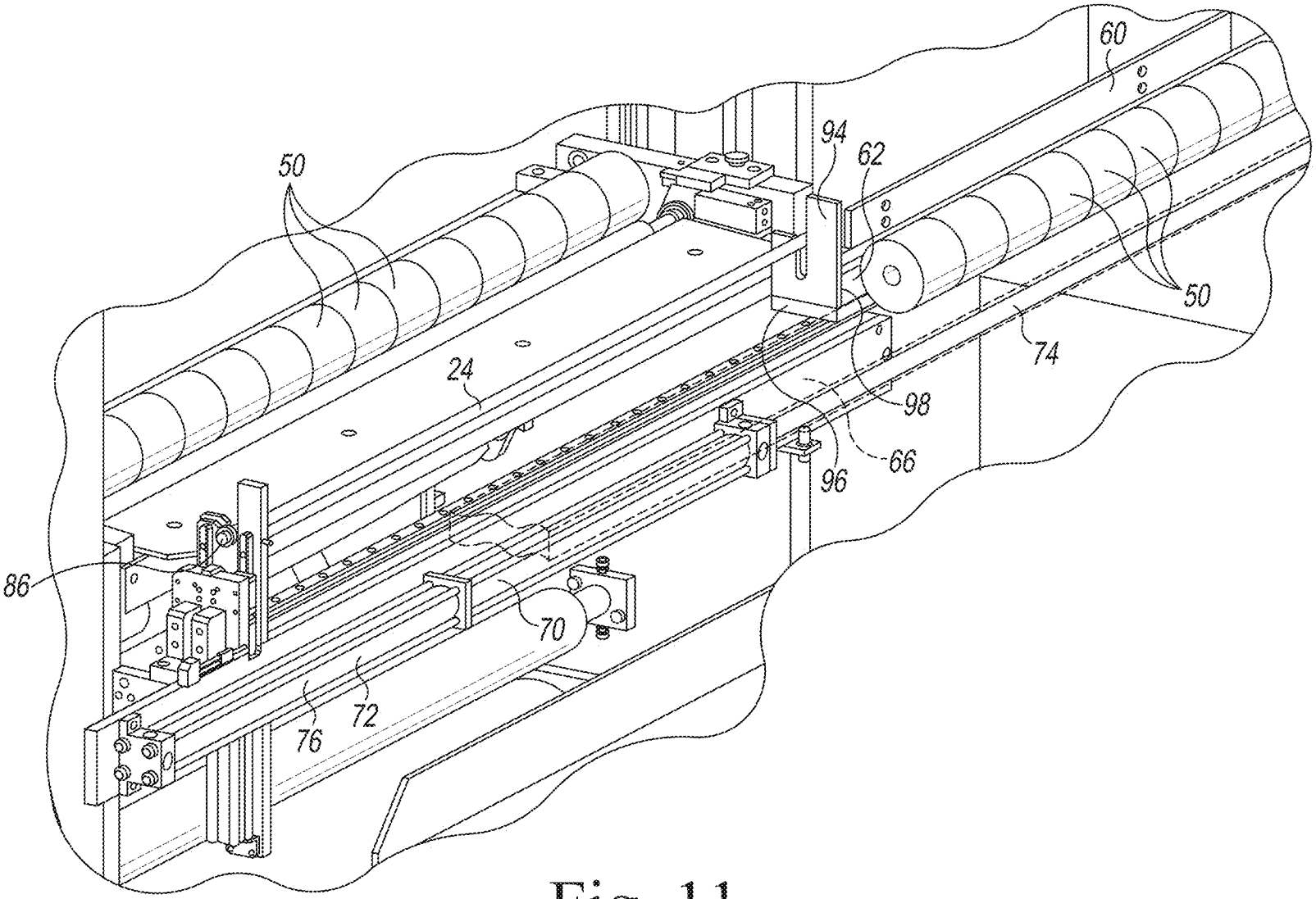

As described above, the collection trough 60 pivots relative to the carriage 62. As can be seen in FIG. 8, the collection trough 60 is positioned in an upright or collection position when the carriage 62 (and hence the collection trough 60) is positioned in its collection position thereby allowing finished coreless retail paper rolls 50 (and hence the rewind arbor 24 around which they are wound) to be collected in the collection trough 60 as they exit the winding assembly 22. As can be seen in FIG. 11, the collection trough 60 is pivoted toward the collection conveyor 66 into a dump position when the carriage 62 (and hence the collection trough 60) is positioned in its transfer position thereby allowing finished coreless retail paper rolls 50 (having been removed from the rewind arbor 24 as described below) to be dumped onto the collection conveyor 66 and thereafter moved by the conveyor 66 to a packaging station (not shown). The collection trough 60 may be pivoted in such a manner by use of a small hydraulic cylinder or other similar actuator (not shown).

The paper rewinding machine 10 includes a hydraulic actuator 70 that is operated to both extract the rewind arbor 24 from the finished coreless retail paper rolls 50 and also move the carriage 62 (and hence the collection trough 60) back and forth along the rail 64 between its collection position (see FIG. 8) and its transfer position (see FIG. 11). Specifically, the hydraulic actuator 70 includes a hydraulic cylinder 72 having a rod 74 extending out of the hydraulic cylinder's housing 76. The distal end 78 of the rod 74 is coupled to a mounting plate 80 on the carriage 62 such that the carriage 62 (and hence the collection trough 60) is moved back and forth along the rail 64 by movement of the rod 74. In the illustrative embodiment described herein, extension of the rod 74 causes the carriage 62 (and hence the collection trough 60) to be moved from its collection position (see FIG. 8) to its transfer position (see FIG. 11). Oppositely, retraction of the rod 74 causes the carriage 62 (and hence the collection trough 60) to be moved from its transfer position (see FIG. 11) to its collection position (see FIG. 8). It should be appreciated; however, that the orientation of hydraulic cylinder 72 could be flipped end-for-end such that extension of its rod 74 moved the carriage (and hence the collection trough 60) in the opposite direction and vice versa in regard to retraction of its rod 74.

Figure 9:
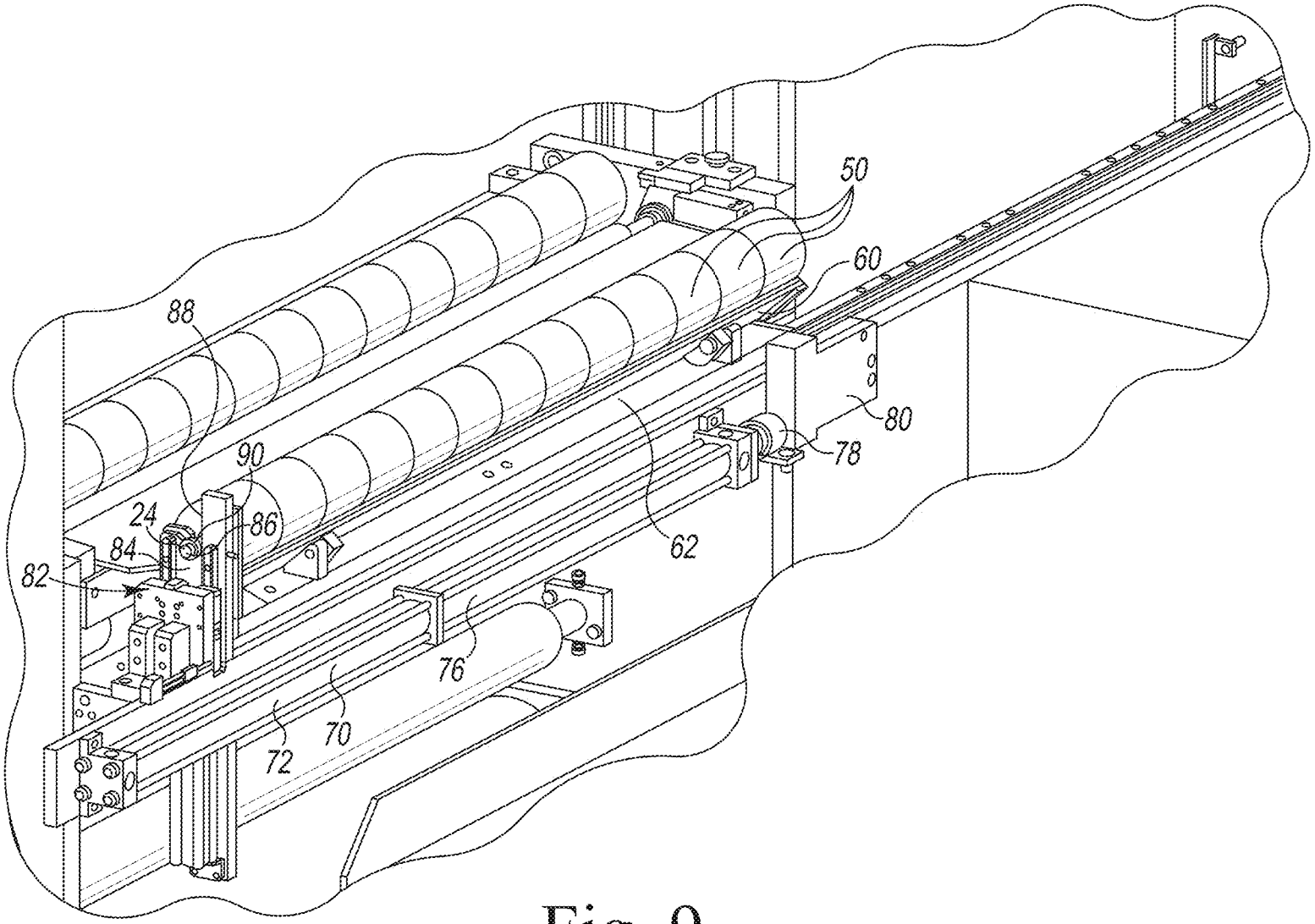

As noted above, movement of the carriage 62 by the hydraulic actuator 70 extracts the rewind arbor 24 from the finished coreless retail paper rolls 50 thereby allowing the rolls 50 to be freed for subsequent transport and processing (e.g., packaging). As will be described below, the winding process for fabricating the finished coreless retail paper rolls 50 produces very tightly wound and hard rolls. As such, traditional methods of removing cored rolls or softer coreless rolls (e.g., manual or pneumatic extraction) are insufficient to remove the finished coreless retail paper rolls 50. As can be seen in FIG. 9, a plurality of the finished coreless retail paper rolls 50 (and hence the rewind arbor 24 around which they are wound) exits the winding assembly 22 and is collected in the collection trough 60. Thereafter, a clamping mechanism 82 clamps or otherwise retains the rewind arbor 24 in a stationary position such that movement of the carriage 62 (and hence the collection trough 60) extracts the rewind arbor 24 from the finished coreless retail paper rolls 50. As can be seen in FIG. 9, the clamping mechanism 82 includes a U-shaped jaw 84 which is movable upwardly into a position in which an end 86 of the rewind arbor 24 is received into a channel 88 formed in the jaw 84. The rewind arbor 24 has a collar 90 formed therein. The collar 90 has a diameter that is larger than the width of the channel 88 formed in the jaw 84. As such, the collar 90 engages, and is retained by, the backside of the jaw 84 during extension of the rod 74 and the associated movement of the carriage 62 (and hence the collection trough 60) from its collection position (see FIG. 8) to its transfer position (see FIG. 11).

Figure 10:
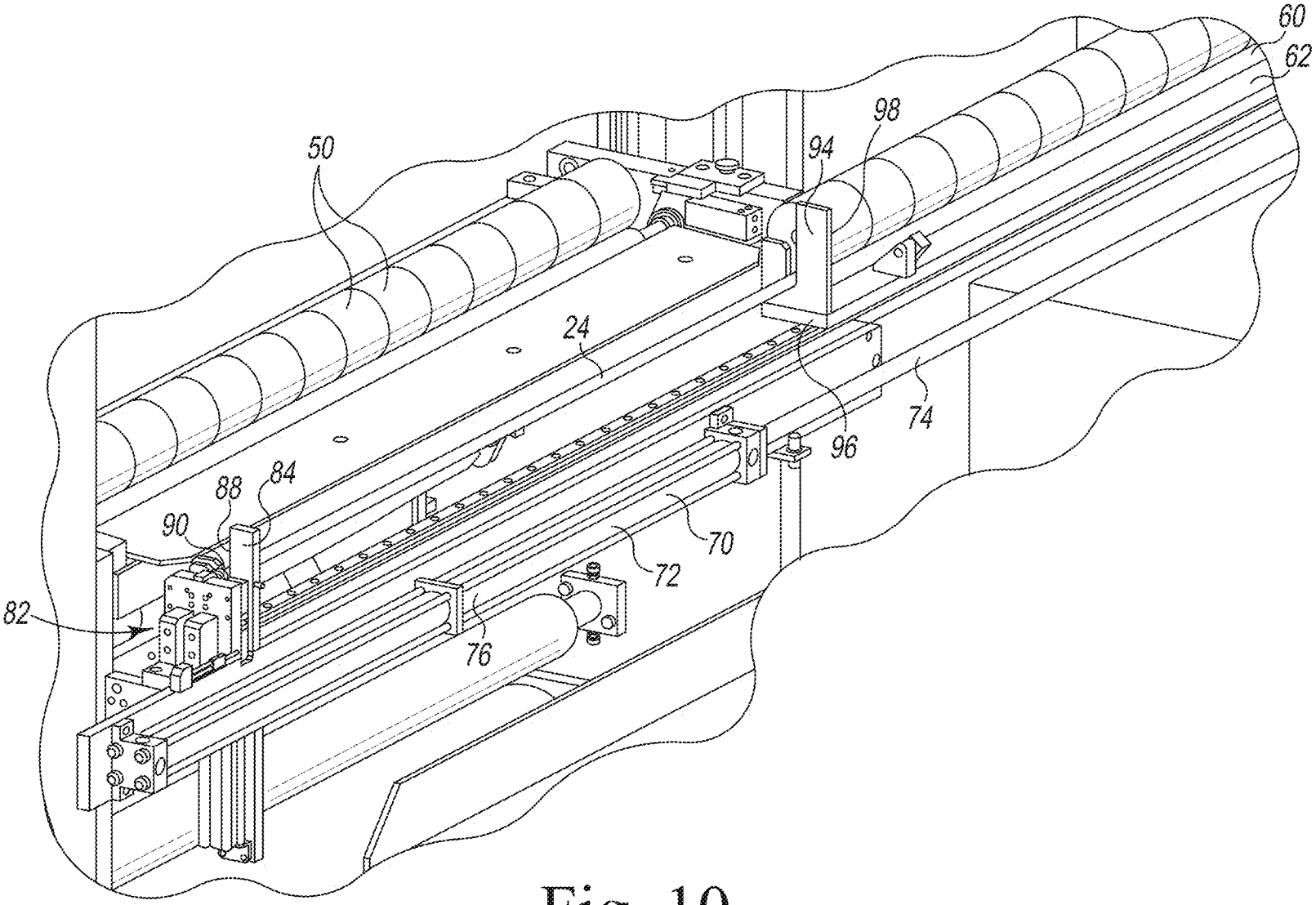

As can be seen in FIG. 10, the carriage 62 has a U-shaped plate 94 secured to its trailing end 96 (i.e., the end that trails during movement of the carriage 62 from its collection position (see FIG. 8) to its transfer position (see FIG. 11)). The front side 98 of the plate 94 contacts the end of the finished coreless retail paper roll 50 closest to it. As the collection trough 60 is moved by the hydraulic actuator 70, the plate 94 asserts a force on the finished coreless retail paper rolls 50 thereby striping them off the rewind arbor 24 as it is held in a stationary position by the clamping mechanism 82.

As the individual rolls 50 are stripped off the rewind arbor 24 during movement of the carriage 62 from its collection position (see FIG. 8) to its transfer position (see FIG. 11), they are collected in the collection trough 60. Once the carriage 62 arrives at its transfer position (as shown in FIG. 11), the collection trough 60 pivots toward the collection conveyor 66 into its dump position thereby causing the finished coreless retail paper rolls 50 to be dumped onto the collection conveyor 66 and thereafter moved by the conveyor 66 to a packaging station (not shown). Thereafter, the collection trough pivots upwardly back into its upright collection position and the carriage 62 is moved back into its starting position (as shown in FIG. 8) by retraction of the rod 74. In such a way, the collection trough 60 is again positioned to collect the next batch of finished coreless retail paper rolls 50 exiting the winding assembly 22 so they can be stripped off their rewind arbor 24 in a similar manner.

It should be appreciated that although the extraction assembly for extracting the coreless retail paper rolls 50 from the rewind arbor 24 is herein described as the hydraulic cylinder 72, and has significant advantages thereby in the design of the paper winding machine 10, the extraction assembly may be embodied as other types of mechanisms and still enjoy certain of such advantages. For example, the extraction assembly may be embodied as a pneumatic cylinder, a rack and pinion assembly, a driven chain and carriage assembly, a driven belt and carriage assembly, a ball screw and carriage assembly, a lever arm assembly, or a winch assembly.

In any such embodiment (including the hydraulic cylinder 72), the extraction assembly generates significantly higher extraction forces than heretofore utilized retail paper winding processes. The extraction force of the extraction assemblies described herein is defined as the force required to remove the coreless retail paper rolls 50 from the winding arbor divided by the combined width of the rolls 50 being removed. For example, an extraction force of 10.0 lbs/in is generated by the extraction assembly when it applies 540 lbs of force to remove rolls having a combined width of 54 in. In an exemplary embodiment, the extraction assemblies of the paper winding machine 10 generates an extraction force of at least 10.0 lbs/in to extract the retail paper rolls 50 from the winding arbor 24. In a more specific exemplary embodiment, the extraction assemblies of the paper winding machine 10 generate an extraction force of at least 17.0 lbs/in to extract the retail paper rolls 50 from the winding arbor 24. In another specific exemplary embodiment, the extraction assemblies of the paper winding machine 10 generate an extraction force of at least 24.0 lbs/in to extract the retail paper rolls 50 from the winding arbor 24. In yet another specific exemplary embodiment, the extraction assemblies of the paper winding machine 10 generate an extraction force of at least 32.0 lbs/in to extract the retail paper rolls 50 from the winding arbor 24. It should be appreciated that extraction assemblies that generate such extraction forces have not been utilized in prior winding systems since such elevated extraction forces were not needed to produce conventional rolls and thereby would have unnecessarily led to increased machine costs and complexities.

As discussed above, the illustrative winding process disclosed herein may be used to fabricate coreless retail paper rolls 50 that are very tightly wound and, as a result, hard relative to rolls produced on heretofore utilized processes. In fact, as will be discussed below, coreless retail paper rolls 50 produced with the concepts disclosed herein have a resistance to crush (Rc) that is many times greater than previously produced coreless retail paper rolls. As will be discussed below, the winding process of the present disclosure utilizes operation of certain components of the winding machine 10 within operating parameters that are not only different from the parameters utilized in prior winding processes, but actually counter to heretofore utilized parameters since, in some cases, they have potential unwanted side effects to prior winding processes (e.g., accelerated component wear).

As described above in regard to FIGS. 2-5, rotation of the bed rollers 30, 32 advances the sheets 20 of retail paper and rotates the rewind arbor 24 thereby winding the sheets 20 of retail paper around the rewind arbor 24 for a preprogrammed period of time to produce coreless retail paper rolls 50 of a specific diameter or a specific length. In an illustrative embodiment of the winding concepts described herein, the rear bed roller 32 is driven (i.e., rotated) at a substantially greater speed than the front bed roller 30. Such "overspeed" of the rear bed roller 32 generates a tighter wind of the retail paper within the rolls 50 relative to rolls produced without such substantial overspeed. In one illustrative embodiment, the rear bed roller 32 is rotated at a speed that is greater than 3% faster than the speed of the front roller 30. In another exemplary embodiment, the rear bed roller 32 is rotated at a speed that is at least 3.75% faster than the speed of the front roller 30. In a more specific exemplary embodiment, the rear bed roller 32 may be rotated at a speed that is at least 4.5% faster than the speed of the front roller 30.

As described above and as can be seen in FIG. 7, in some machine configurations, the primary rider roller 40 rides directly on top of the growing (i.e., expanding) rolls as the sheets 20 of retail paper are wound around the rewind arbor by rotation of the bed rollers 30, 32. The primary rider roller 40 is driven by a motor 28 (see FIG. 7). The torque produced by the motor 28, and hence exerted by the primary rider roller 40 onto the roll, generates a force on the roll in a direction that is tangent to the round outer surface of the roll (i.e., the vector of the force applied to the roll by the torque of the motor-driven rider roller 40 is tangent to the outer surface of the roll). As such, the force created by the torque applied to rider roller creates a cinching effect on the roll as it grows (i.e., expands) during winding thereof. The amount of force applied by the motor-driven primary rider roller 40 onto the coreless retail paper rolls as they are being wound may be varied by varying the output of the rider roller's drive motor 28. Indeed, the magnitude of the torque applied on the rider roller is calculated by determining the torque being generated by the drive motor 28 and reducing the same by the ratio of the drive pulley assembly 48 (see FIG. 7) which couples the motor 28 to the rider roller 40. Dividing the torque applied to the rider roller 40 by the roller's radius produces the force applied tangentially to the surface of the retail paper rolls being wound upon the winding arbor 24. In a specific illustrative example, a 7.5 Hp motor 28 utilizing two-thirds of its capacity generates 14.59 lb-ft torque with such a maximum torque being decreased by a drive pulley assembly 48 having a ratio of 0.46 so as to produce a resulting torque applied to the rider roller 40 of 6.7 lb-ft (or 80.4 lb-in). Thus, in the case of a rider roller having a radius 0.875", the resulting force applied tangentially to the surface of the retail paper rolls being wound upon the winding arbor 24 is 91.8 lbs (or 1.7 lbs/in when the retail paper rolls 50 wound on the winding arbor 24 have a combined width of 54").

It should be appreciated that such a tangential force may just as readily be applied to the surface of the retail paper rolls being wound upon the winding arbor 24 through the use of the secondary rider roller 26. In particular, in some machine configurations, a rewind arbor 24 of a relatively small diameter may be needed to produce coreless retail paper rolls 50 with relatively small inner diameters. The size of such small rewind arbors 24 may not exceed the void created by a typical rider roller 40 and bed rollers 30, 32. In such cases, a smaller diameter secondary rider roller 26 and set of bed rollers 30, 32 may be used. This would allow for the secondary rider roller 26 to be positioned between the primary rider roller 40 and the rewind arbor 24 during winding. In such a way, the secondary rider roller 26 is in direct contact with the retail paper rolls being wound upon the winding arbor 24. The use of such a secondary rider roller 26 is shown in FIGS. 2-6. In such an illustrative arrangement, the secondary rider roller 26 is driven by the drive motor 28 via the primary rider roller 40. In other words, the secondary rider roller 26 is an idler roller that is mechanically driven by the drive motor 28 through primary rider roller 40.

Because the secondary rider roller 26 is driven by the drive motor 28 (albeit through the primary rider roller 40), the amount of tangential force applied onto the coreless retail paper rolls as they are being wound may be varied during use of the secondary rider roller 26 by varying the output of the drive motor 28 in a similar manner to as described above in regard to use of the primary rider roller 40. As used herein, the term "rider roller" when used to describe the application of a tangential force onto the coreless retail paper rolls as they are being wound may imply either of the primary rider roller 40 or the secondary rider roller 26 unless referring specifically to one of them.

In the illustrative embodiment of the winding concepts described herein, the force applied tangentially to the surface of the retail paper rolls being wound upon the winding arbor 24 is significantly higher than heretofore utilized retail paper winding processes. In an exemplary embodiment, a force of at least 1.1 lbs/in is tangentially applied to the surface of the retail paper rolls being wound upon the winding arbor 24. In a more specific exemplary embodiment, a force of a least 1.4 lbs/in is tangentially applied to the surface of the retail paper rolls being wound upon the winding arbor 24. In yet another specific exemplary embodiment, a force of a least 1.7 lbs/in is tangentially applied to the surface of the retail paper rolls being wound upon the winding arbor 24. It should be appreciated that application of such high tangential forces generates a tighter wind of the retail paper within the rolls 50 relative to rolls produced with lower tangential forces. It should also be appreciated that such higher tangential forces have not been applied in prior winding systems since such elevated forces were not needed to produce conventional rolls and were believed to unnecessarily lead to reduced machine efficiencies due to torn paper feeds and excessive component wear.

Figure 6:
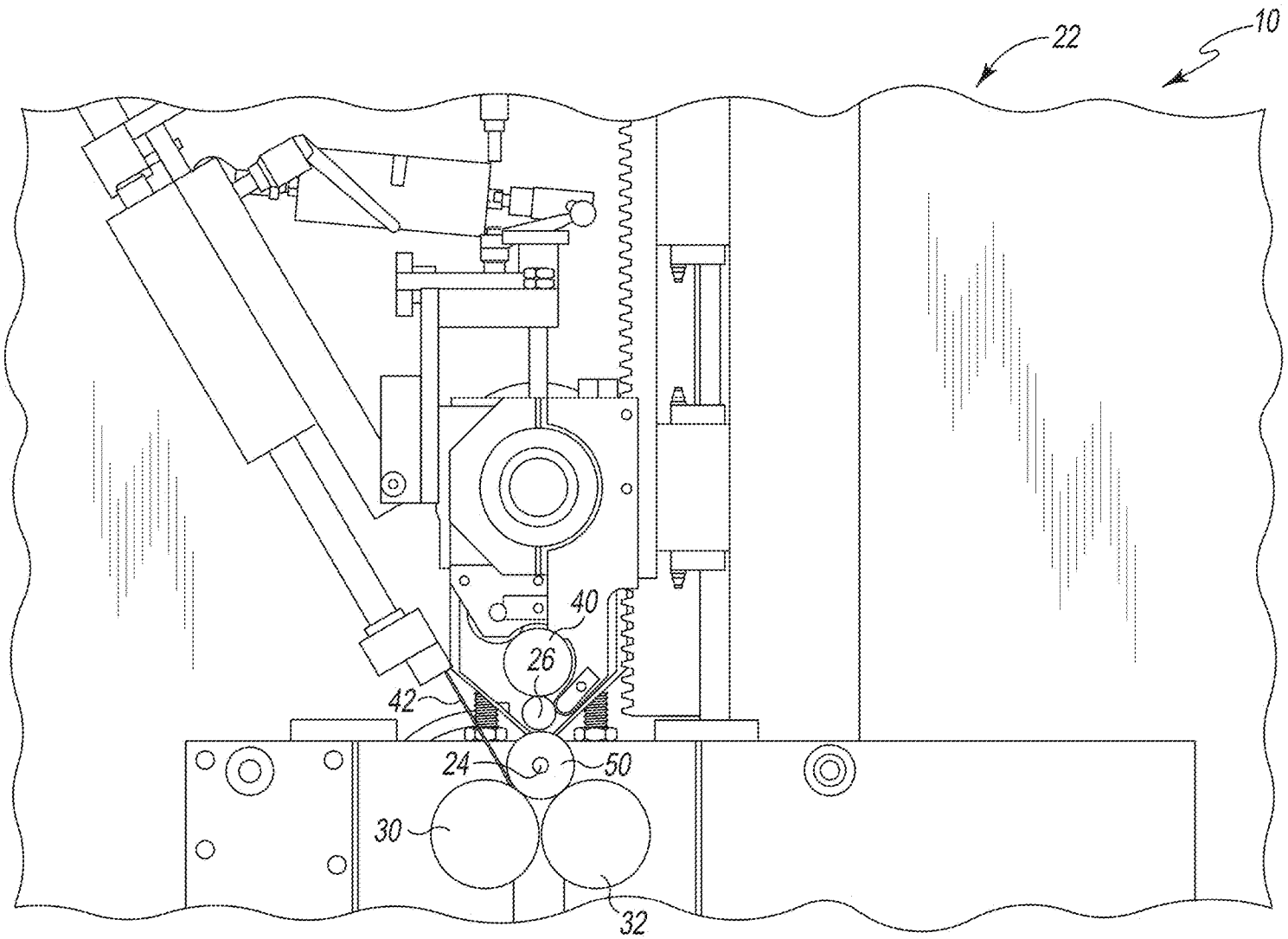
FIG. 6 is a view similar to FIG. 5, but showing the finished coreless retail paper rolls.
Figure 7:
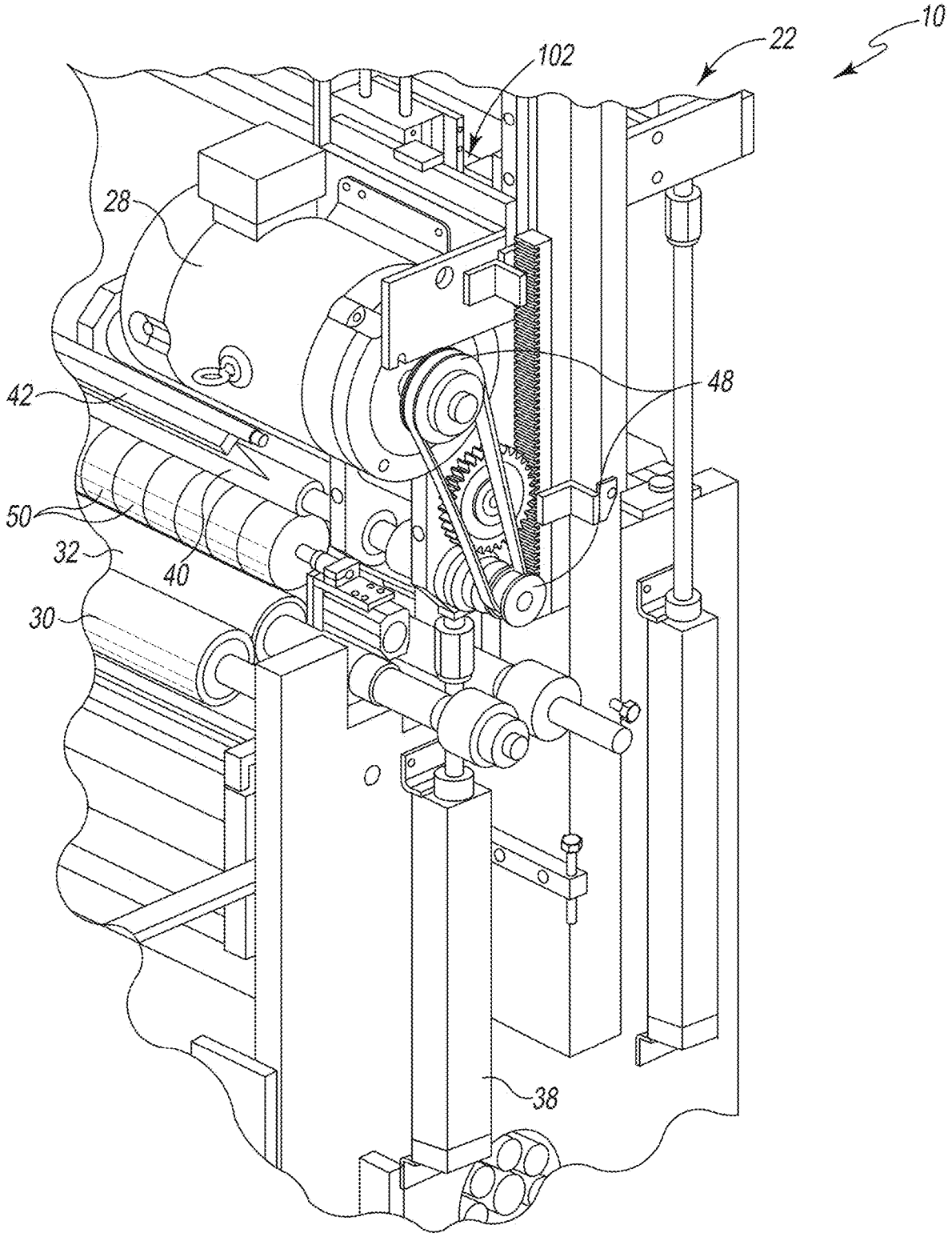
FIG. 7 is a fragmentary side elevational view of the paper winding machine of FIG. 1.

As shown in FIG. 6, the rider roller 40, its drive motor 28 and pulley assembly 48, and other components of the rewind assembly 22 are mounted to a bridge assembly 102. The weight of the bridge assembly 102 exerts a downward pack force that is exerted on the growing (i.e., expanding) rolls through the primary rider roller 40 (or the secondary rider roller 26 if it is being used) as the sheets 20 of retail paper are being wound around the rewind arbor 24. Unlike the torque applied to the primary rider roller 40 (or the secondary rider roller 26 if it is being used) which generates a tangential force on the retail paper rolls being wound upon the winding arbor 24, the downward pack force created by the weight of the bridge assembly 102 exerts a force in a direction that is orthogonal to the longitudinal axis of the rewind arbor 24 and hence the round outer surface of the roll (i.e., the vector of the force applied to the roll by the pack force created by the weight of the bridge assembly 102 is orthogonal to the longitudinal axis of the rewind arbor 24 and hence the round outer surface of the roll). In such a way, the pack force created by the weight of the bridge assembly 102 acts to "iron out" the retail paper roll as it grows (i.e., expands) during winding thereof. In particular, air can be trapped at the nip point (i.e., the point where the incoming retail paper feed meets the roll) which makes the resultant rolls somewhat "fluffy". The downward pack force removes such trapped air (i.e., "irons it out") as the retail paper is wound around the growing (i.e., expanding) roll thereby producing tighter wound rolls. The pack force is defined as the force applied to the surface of the coreless retail paper rolls 50 being wound upon the winding arbor 24 divided by the combined width of the rolls 50 being wound. For example, a pack force of 10.0 lbs/in is created when 540 lbs of force is applied to rolls 50 having a combined width of 54 in.

The cylinders 38 (see FIG. 7) are used as counterbalances to produce a predetermined desired pack force on the rider roller 40 and hence the sheets 20 of retail paper being wound around the rewind arbor 24. The pack force maintained by the cylinders 38, and hence exerted by the rider roller 40 onto the roll, is significantly higher than heretofore utilized retail paper winding processes. In an exemplary embodiment, a pack force of at least 6.0 lbs/in is applied to the surface of the retail paper rolls being wound upon the winding arbor 24. In a more specific exemplary embodiment, a pack force of at least 8.0 lbs/in is applied to the surface of the retail paper rolls being wound upon the winding arbor 24. In another specific exemplary embodiment, a pack force of at least 10.0 lbs/in is applied to the surface of the retail paper rolls being wound upon the winding arbor 24. It should be appreciated that application of such high pack forces on the rider roller 40 generates a tighter wind of the retail paper within the rolls 50 relative to rolls produced with lower pack forces. It should also be appreciated that such higher pack forces on the rider roller 40 have not been utilized in prior winding systems since such elevated pack forces were not needed to produce conventional rolls and were believed to unnecessarily lead to reduced machine efficiencies due to torn paper feeds and excessive component wear.

It should be appreciated that each of the above-described parameters (i.e., rear bed roller overspeed, rider roller torque, and applied pack force) may be used separately or in combination to produce coreless retail paper rolls 50 of a desired tightness and/or hardness. Through significant engineering effort and experimentation, particular combinations of the above described parameters have been found to produce coreless retail paper rolls 50 of a desired tightness and/or hardness.

In one illustrative embodiment, coreless retail paper rolls 50 of a desired tightness and/or hardness are produced by operating the winding machine 10 at a combination of controlled parameters including (1) rotating the rear bed roller 32 at a speed that is between 3.1-4.5% faster than the speed of the front roller 30, (2) applying a torque on the rider roller 40 that produces a tangential force of 1.1-1.7 lbs/in on the surface of the retail paper rolls being wound upon the winding arbor 24, and (3) operating the cylinders 38 to apply a pack force of 6.0-10.0 lbs/in to the surface of the retail paper rolls being wound upon the winding arbor.

In a more specific illustrative embodiment, coreless retail paper rolls 50 of a desired tightness and/or hardness are produced by operating the winding machine 10 at a combination of controlled parameters including (1) rotating the rear bed roller 32 at a speed that is greater than 3.0% faster than the speed of the front roller 30, (2) applying a torque on the rider roller 40 that produces a tangential force of at least 1.1 lbs/in on the surface of the retail paper rolls being wound upon the winding arbor 24, and (3) operating the cylinders 38 to apply a pack force of at least 6.0 lbs/in to the surface of the retail paper rolls being wound upon the winding arbor.

In yet a more specific illustrative embodiment, coreless retail paper rolls 50 of a desired tightness and/or hardness are produced by operating the winding machine 10 at a combination of controlled parameters including (1) rotating the rear bed roller 32 at a speed that is between 3.75-4.5% faster than the speed of the front roller 30, (2) applying a torque on the rider roller 40 that produces a tangential force of 1.4-1.7 lbs/in on the surface of the retail paper rolls being wound upon the winding arbor 24, and (3) operating the cylinders 38 to apply a pack force of 8.0-10.0 lbs/in to the surface of the retail paper rolls being wound upon the winding arbor.

In another more specific illustrative embodiment, coreless retail paper rolls 50 of a desired tightness and/or hardness are produced by operating the winding machine 10 at a combination of controlled parameters including (1) rotating the rear bed roller 32 at a speed that is approximately 4.5% faster than the speed of the front roller 30, (2) applying a torque on the rider roller 40 that produces a tangential force of approximately 1.7 lbs/in on the surface of the retail paper rolls being wound upon the winding arbor 24, and (3) operating the cylinders 38 to apply a pack force of approximately 10.0 lbs/in to the surface of the retail paper rolls being wound upon the winding arbor.

In yet another more specific illustrative embodiment, coreless retail paper rolls 50 of a desired tightness and/or hardness are produced by operating the winding machine 10 at a combination of controlled parameters including (1) rotating the rear bed roller 32 at a speed that is at least 4.5% faster than the speed of the front roller 30, (2) applying a torque on the rider roller 40 that produces a tangential force of at least 1.7 lbs/in on the surface of the retail paper rolls being wound upon the winding arbor 24, and (3) operating the cylinders 38 to apply a pack force of at least 10.0 lbs/in to the surface of the retail paper rolls being wound upon the winding arbor.

It should be appreciated that other combinations of the three parameters are also contemplated. For example, increasing one of the parameters may allow another of the parameters to be reduced to fit the needs of a given winding machine 10. For instance, some winding machines 10 may have an existing drive motor 28 that is not capable of generating a desired relatively high torque on the rider roller 40. In such cases, one or both of the rear bed roller overspeed or the pack force amount may be increased to make up for any limitations in the torque on the rider roller 40 caused by the size of its drive motor 28.

It should also be appreciated that other mechanical changes may be made to the winding machine 10 relative to heretofore designed winding machines to facilitate production of the coreless retail paper rolls 50 described herein. For example, the number of rotary support bearings may be increased on each of the bed rollers 30, 32. In a specific illustrative embodiment, each of the bed rollers 30, 32 is supported by two support bearings on each end thereof (a total of four bearing for each roller). Such enhanced bearing support counters the increased deflection associated with using smaller bed rollers 30, 32 relative to heretofore designs of winding machines.

The coreless retail paper rolls 50 produced by the above described procedure and mechanism have an enhanced resistance to being crushed when subjected to various forces such as, for example, the forces the rolls are subjected to during shipment. One method of measuring the resistance to crush of the coreless retail paper rolls 50 made by use of the above described procedure and mechanism utilizes a constant-rate-of-crosshead movement apparatus referred to as an ADMET eXpert 5602 Dual Column Test System. The apparatus is commercially available from ADMET, Inc. located at 51 Morgan Drive, Norwood, Mass. 02062 (Website: www.admet.com). The apparatus may include an ADMET eXpert 5602 Dual Column Test System; 1500 series 300 LB load cell; an eXpert 5602 Actuator; an eP 2 Digital Controller & GuageSafe Basic Data Exchange and Reporting Program; GuageSafe Live Data Exchange and Reporting Software; a Deflection Indicator; Adaptor Package; One ⅝" Male Eye End to ¼-28M-One ⅝" Male Eye to End to ½-20M-5/16" mounting pins (used to mount grips and fixtures); and two CPS-20T-250S, Square Compression Platens, 20 kN, 250 mm Square.

As indicated above the apparatus is used to determine the crush resistance of a paper roll, for example a coreless retail paper roll 50 of the present disclosure. The terminology used to assess crush resistance of a paper roll is as follows:

Load—force applied to a roll in pounds (lbs);

d—measured distance change in roll OD in inches;

Roll OD—measured outer diameter of roll in inches;

Roll ID—measured inner diameter of roll in inches;

Roll Width—measured width of roll along its axis in inches;

F—Calculated Load divided by Roll Width in lbs/inch; and

Rc=F/d—Resistance to crush in lbs/in/in. Rc value calculated by dividing F by d.

Figure 12:
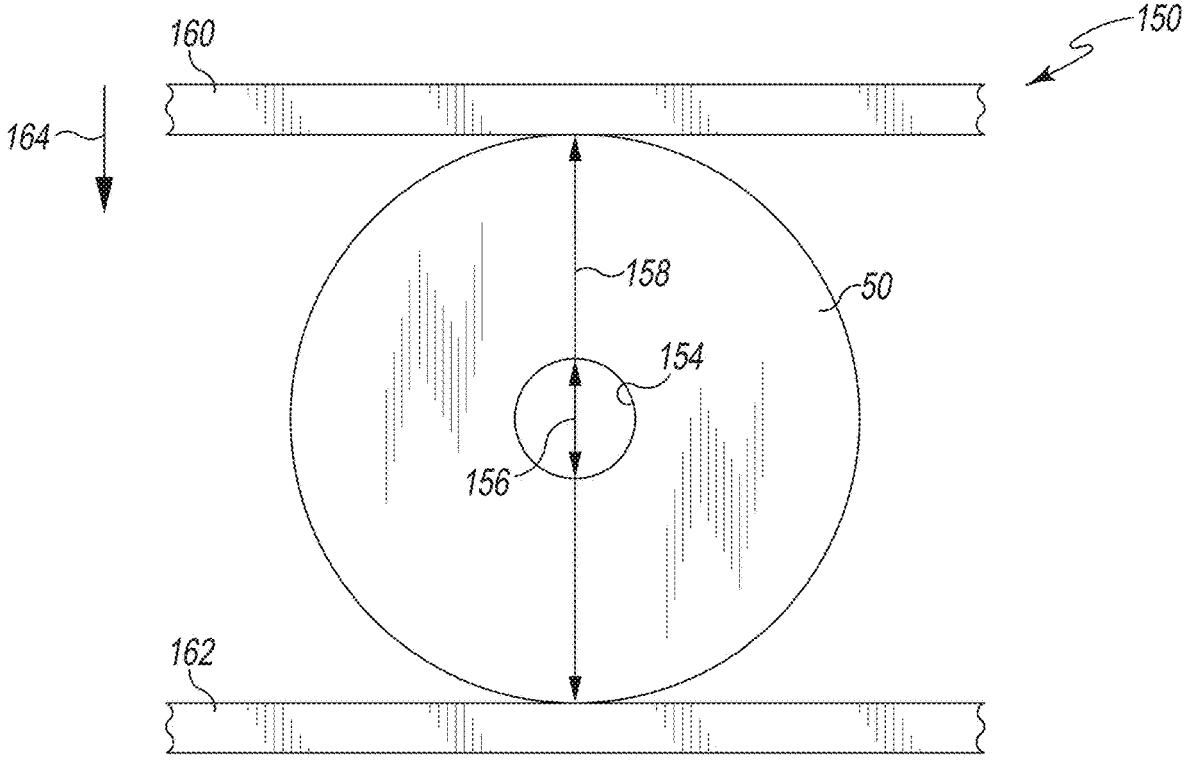
FIG. 12 is a diagrammatic view of a coreless retail paper roll placed between platens of an apparatus for measuring the resistance to crush of the roll.
Figure 13:
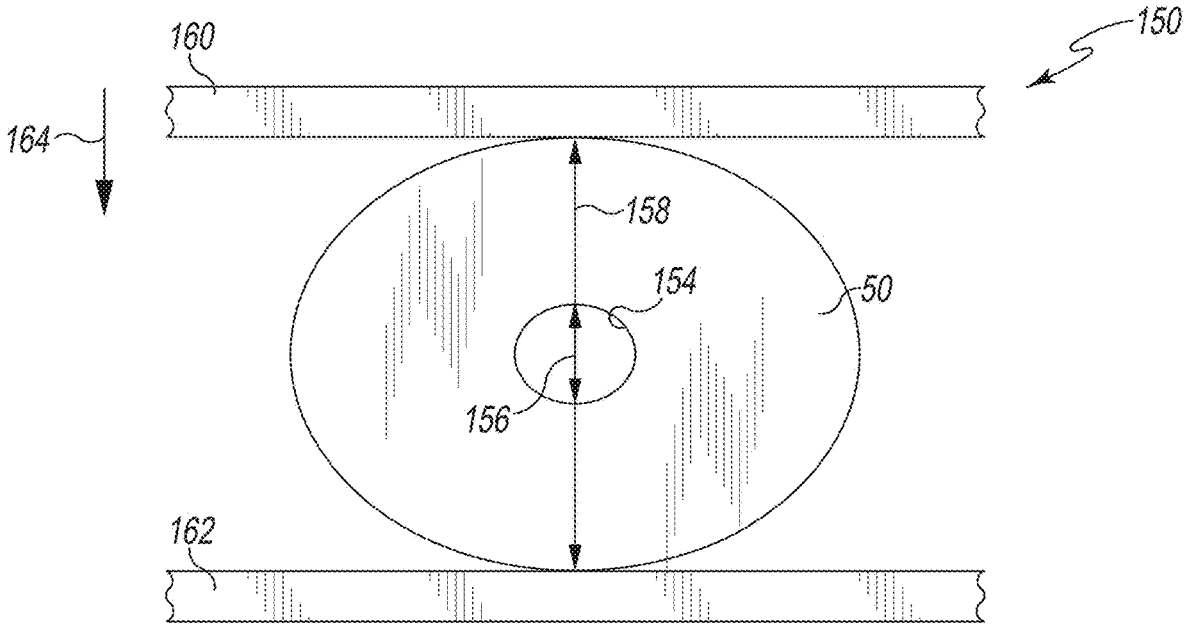
FIG. 13 is a view similar to FIG. 12, but showing the coreless retail paper roll after initiating a protocol for measuring the resistance to crush of the roll.

FIGS. 12 and 13 illustrate a portion 150 of the above described apparatus being used to assess the resistance to crush (Rc) of the coreless retail paper rolls 50 of the present disclosure. During operation of the apparatus, a coreless retail paper roll 50 having a central hole 154, an inner diameter 156, and an outer diameter 158 is placed between, and in contact with, two square compression platens 160 and 162. Note that only a portion of the platens is shown. Also note that the length of each platen 160 and 162 is equal to, or exceeds, the width of the roll 50. Further note that the width of each platen 160 and 162 is not less than the specimen contact width at maximum deflection plus one inch. The platen 160 is then brought closer to platen 162 in the direction indicated by arrow 164 at a rate of, for example, 0.30 in/min. Moving the platen 160 in this manner with an appropriate force results in the deformation of the roll 50 as illustrated in FIG. 13 (note that the deformation of roll 50 in FIG. 13 is exaggerated for clarity of description). During deformation of the roll 50 any change in the outer diameter 158 of the roll 50 is continuously measured and recorded. The change in the outer diameter 158 during loading is used to calculate Rc (as lbs/in/in). Note that the above procedure can be used to test coreless paper rolls and paper rolls containing a core.

The sequential operational steps of using the apparatus to determine Rc of the coreless retail paper rolls 50 are as follows:

1. Determine the width of the coreless retail paper roll 50 to the nearest 0.01";
2. Measure the outer diameter 158 to the nearest 0.01";
3. Measure the inner diameter 156 to the nearest 0.01";
4. Locate the coreless retail paper roll 50 with its longitudinal axis parallel to the platens 160 and 162 and center it laterally in the apparatus;
5. With the deflection indicator in place, bring platen 160 into contact with the roll 50 with a load of one-pound of force. This establishes the beginning point for subsequent deflection measurements;
6. Compress the roll 50 at a constant rate of 0.30 in./min;
7. Record load-deflection measurements at a rate of 5/second; and
8. Discontinue the test when the deflection of the outer diameter 158 of the coreless retail paper roll 50 reaches 30% of the roll's initial inner diameter 156.

Based on the operational steps described above, it should be appreciated that resistance to crush (Rc) is measured only through a certain degree deflection of the coreless retail paper rolls 50, but not through complete collapse of the roll. Specifically, as noted in step 8 above, resistance to crush (Rc) is not calculated based on measurements beyond when the outer diameter 158 of the coreless retail paper roll 50 has been deflected to 30% of the roll's initial inner diameter 156. This is because at some high load, a given roll will completely collapse at which point the roll will become extremely resistant to any further deflection since it has been reduced to a mass of compressed paper (i.e., it no longer has the structure of a roll). Measurements at or near such a point are beyond the scope of resistance to crush (Rc) as used herein since they do not reflect a roll's ability to resist being crushed since it has already been crushed. As such, as used herein (including the claims), the term "resistance to crush" and/or "Rc" refers to its calculated value (as defined above) as measured during testing (as described in the operational steps above) up to the point when the outer diameter 158 of the coreless retail paper roll 50 has been deflected to 30% of the roll's initial inner diameter 156. Calculations based on measurements taken on rolls that have been deflected beyond that point (i.e., beyond when the outer diameter 158 of the coreless retail paper roll 50 has been deflected to 30% of the roll's initial inner diameter 156) are not within the meaning of the term "resistance to crush" and/or "Rc" as it is defined herein.

A sample of ninety coreless retail paper rolls 50 of the present disclosure was subjected to the above described procedure using the apparatus. The rolls were broken into nine groups based upon their inner and outer diameters with each group containing ten rolls (all the rolls 50 within a group had the same width). The collected data was used to generate the graphs, or crush profiles, shown in FIGS. 14-22, with each graph representing one Roll Group and each line in the graph representing one roll 50 of the group. For example, in FIG. 14 each of the ten rolls in Roll Group 1 had an inner diameter (ID) of 0.5 inches, an outer diameter (OD) of 1.2 inches, and a width (W) of 3.15 inches as indicated in the title of the graph; each line in the graph represents one roll of the group (note that there may not be ten discernable lines in the graph because some lines are on top of others).

Figure 14:
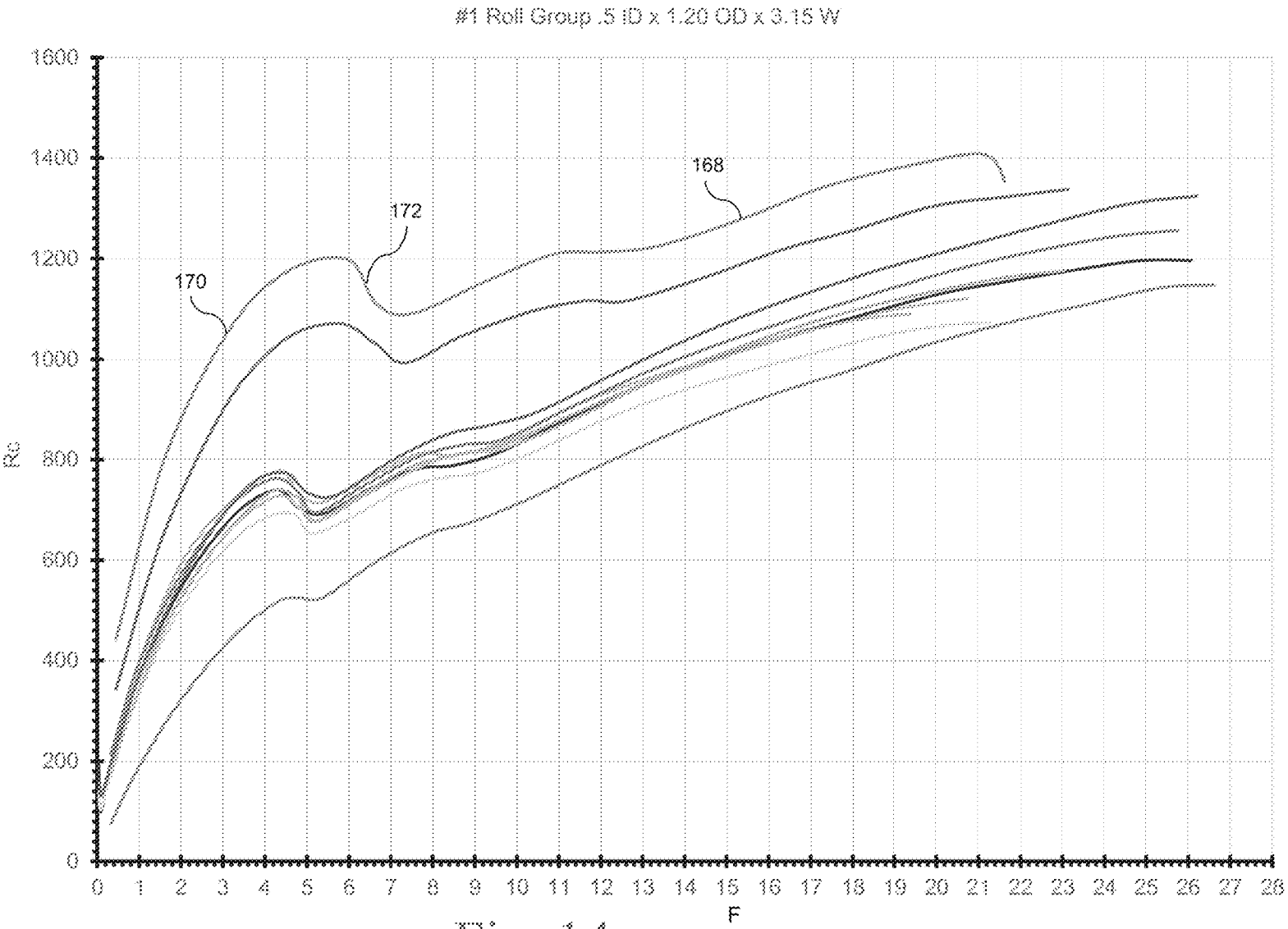
FIG. 14 is a graph showing the resistance to crush (Rc) profile of a coreless retail paper roll of group 1.
Figure 15:
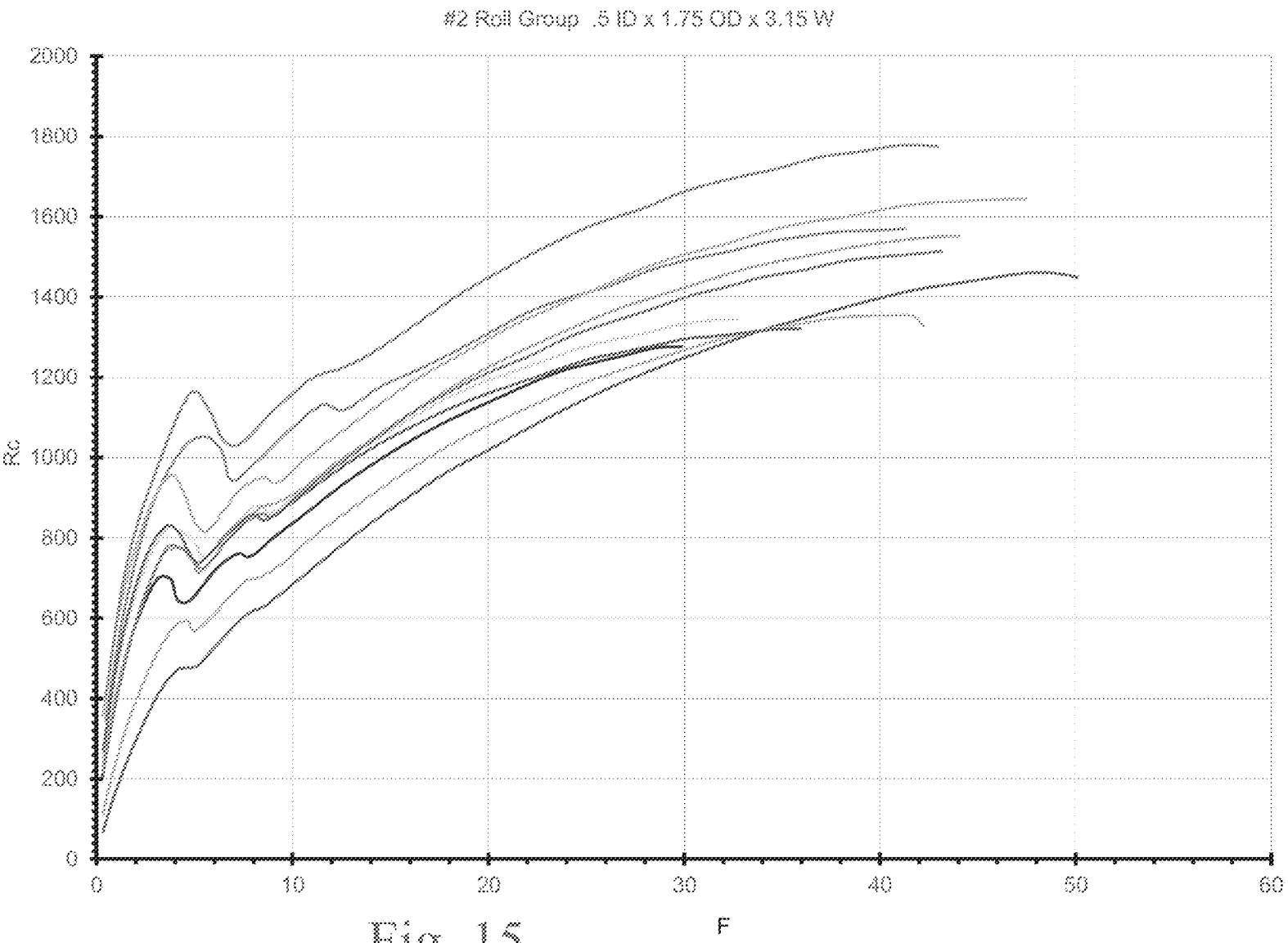
FIG. 15 is a graph showing the resistance to crush (Rc) profile of a coreless retail paper roll of group 2.
Figure 16:
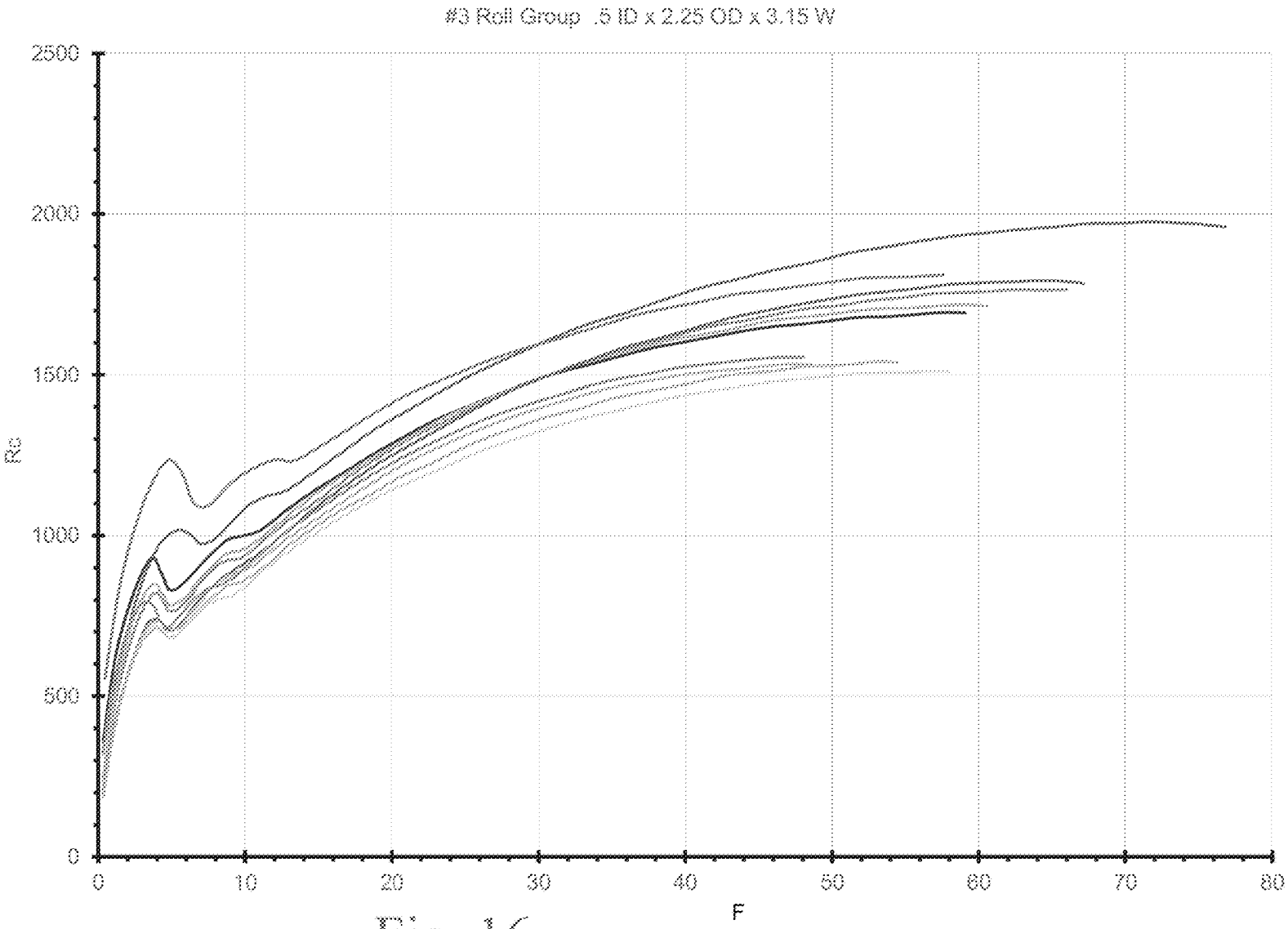
FIG. 16 is a graph showing the resistance to crush (Rc) profile of a coreless retail paper roll of group 3.
Figure 17:
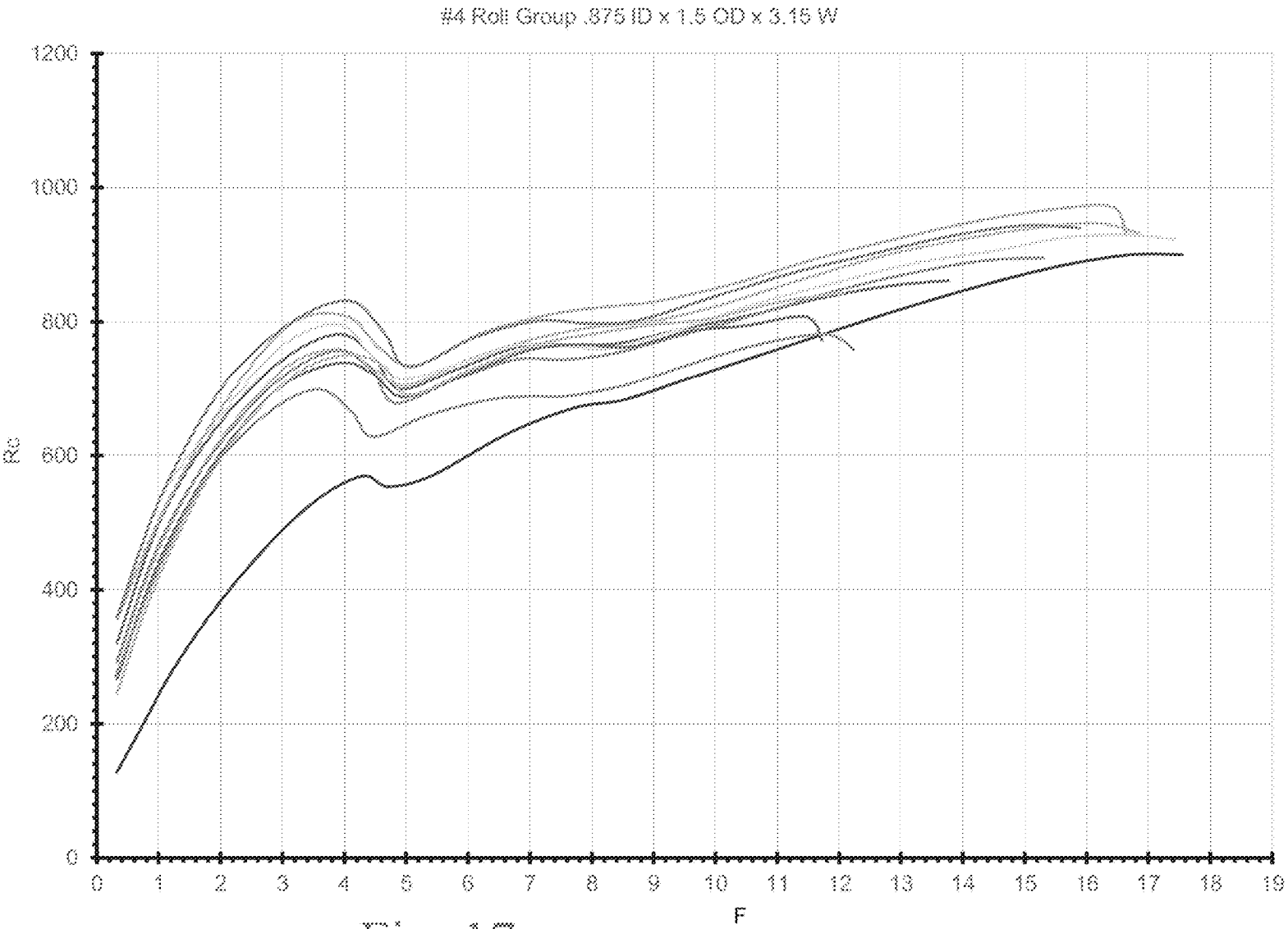
FIG. 17 is a graph showing the resistance to crush (Rc) profile of a coreless retail paper roll of group 4.
Figure 18:
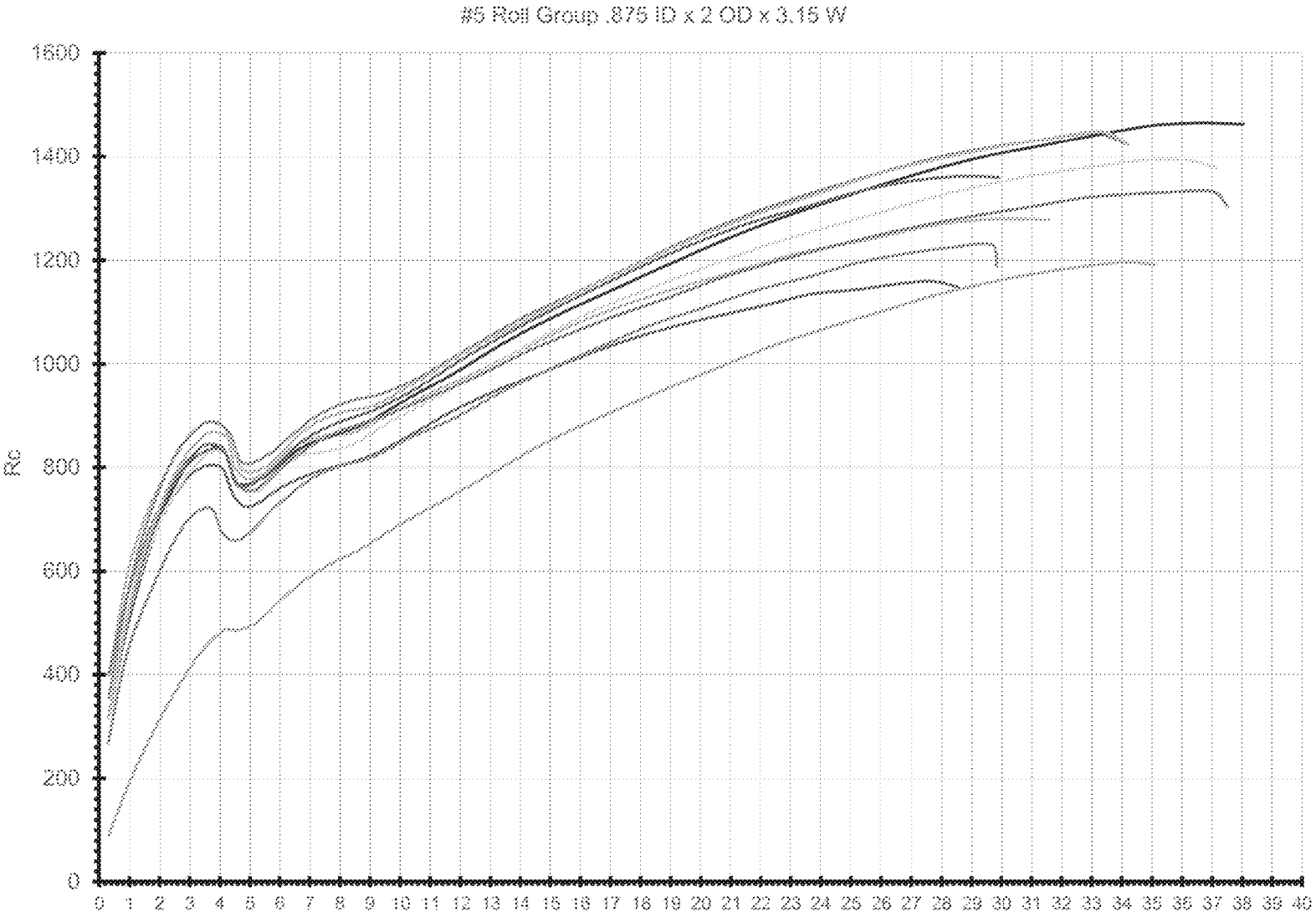
FIG. 18 is a graph showing the resistance to crush (Rc) profile of a coreless retail paper roll of group 5.
Figure 19:
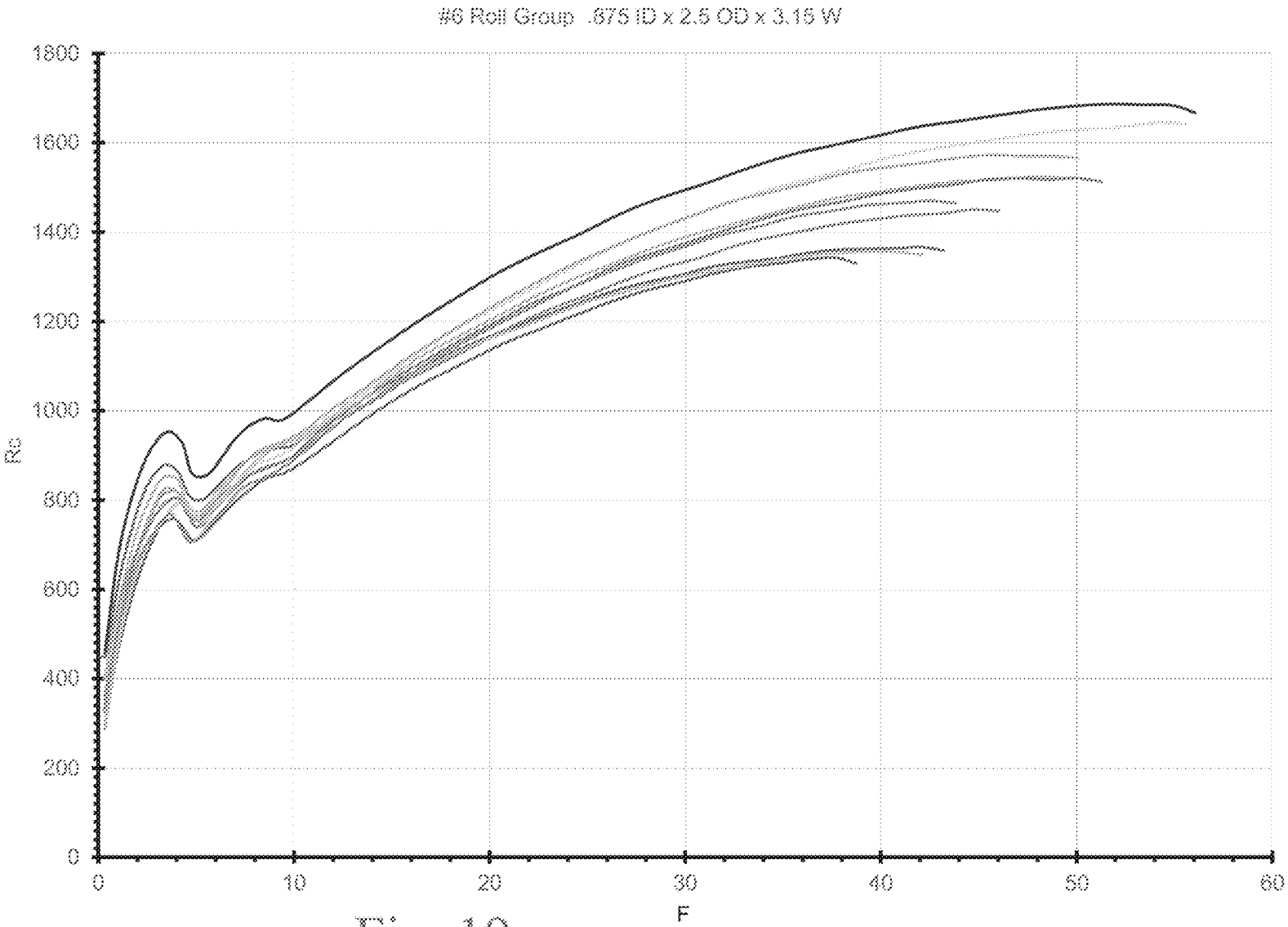
FIG. 19 is a graph showing the resistance to crush (Rc) profile of a coreless retail paper roll of group 6.
Figure 20:
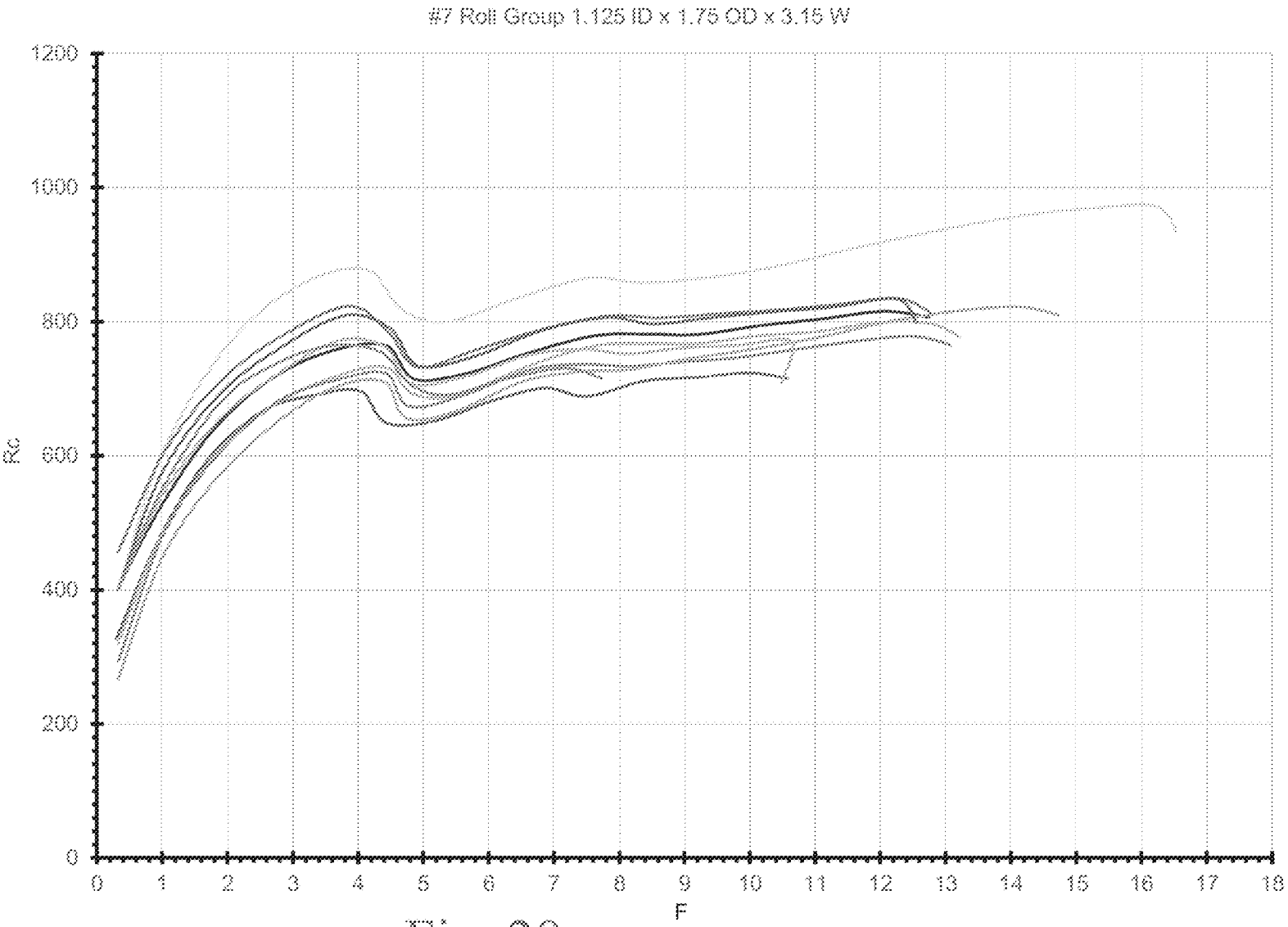
FIG. 20 is a graph showing the resistance to crush (Rc) profile of a coreless retail paper roll of group 7.
Figure 21:
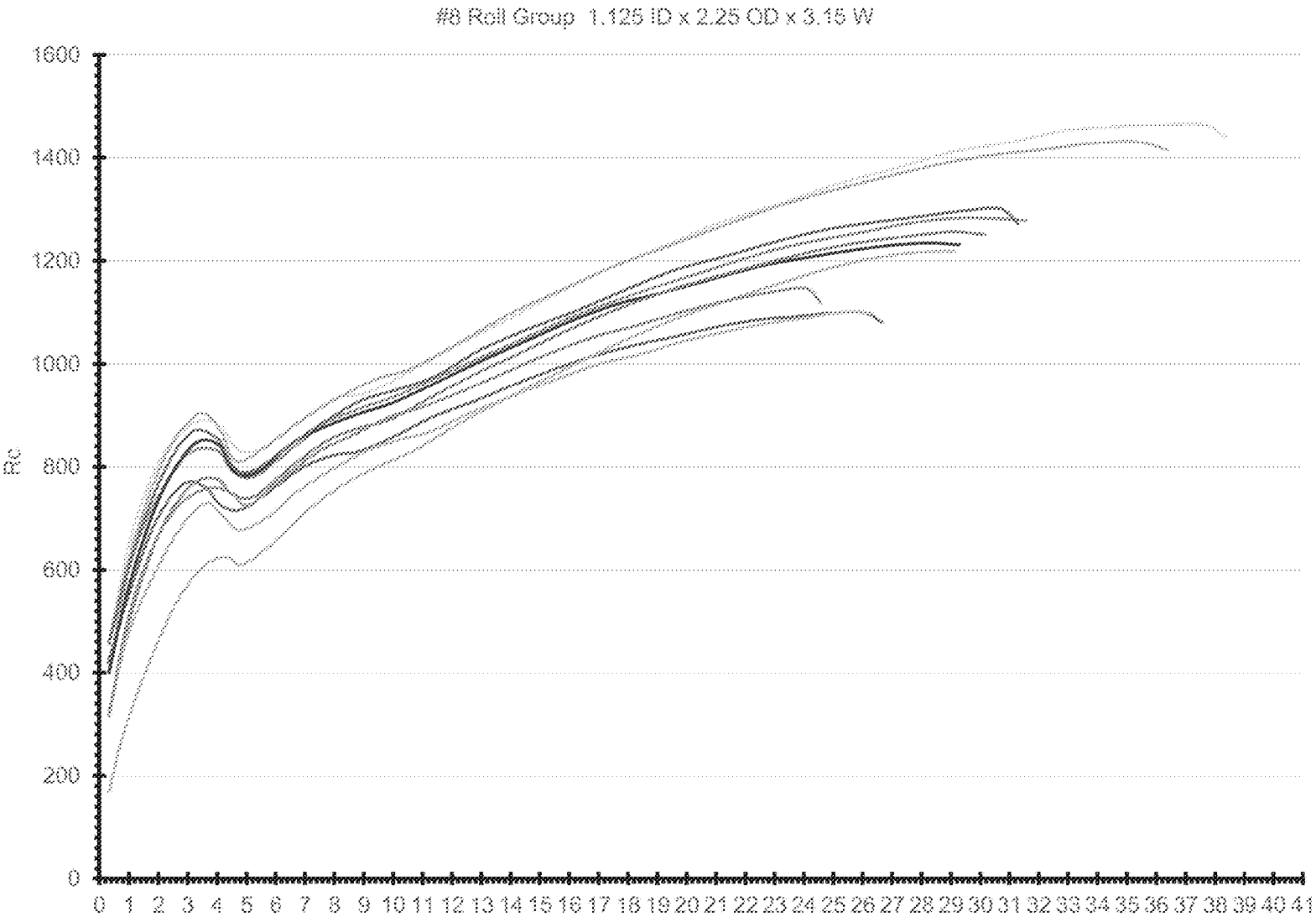
FIG. 21 is a graph showing the resistance to crush (Rc) profile of a coreless retail paper roll of group 8.
Figure 22:
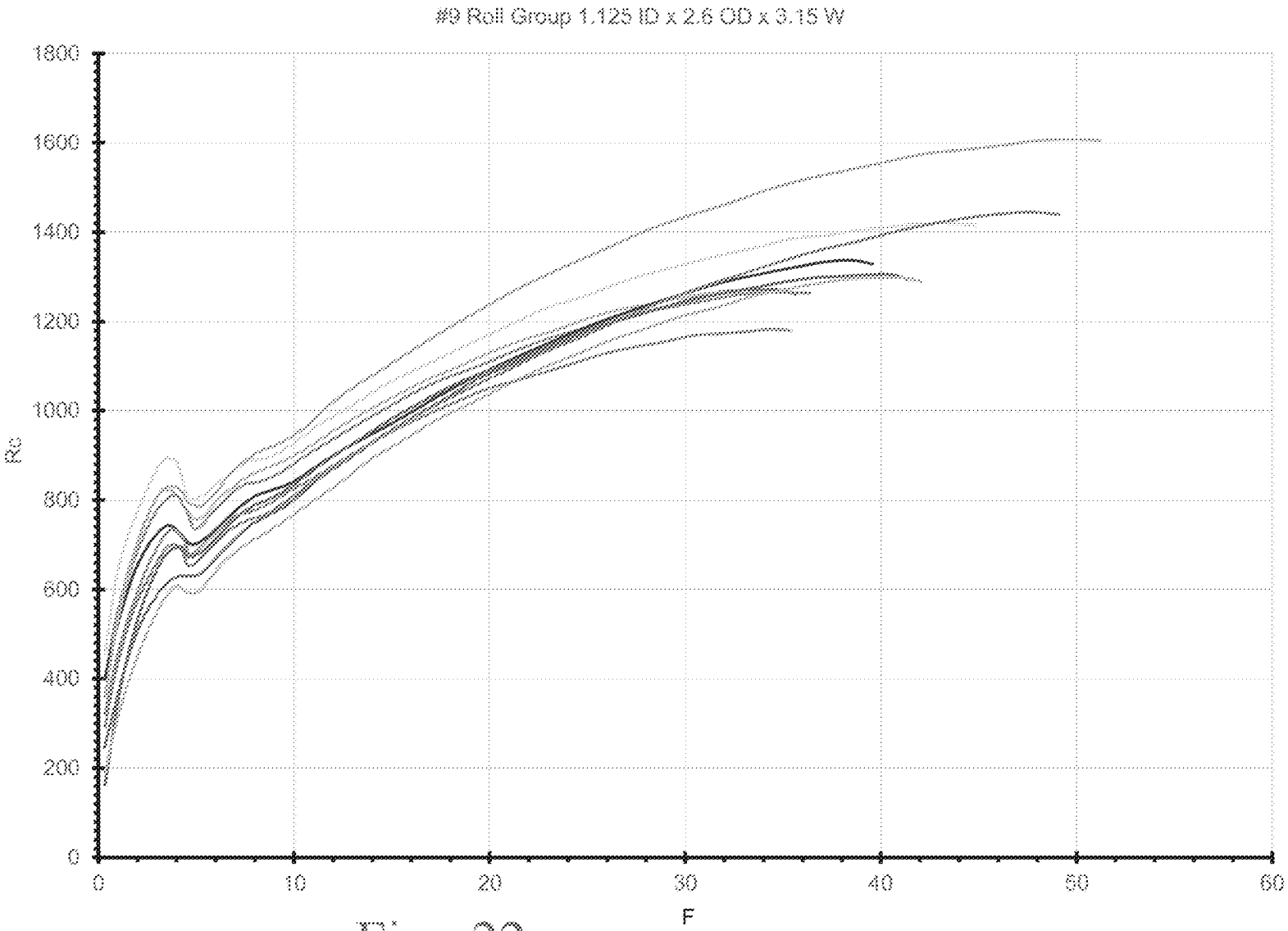
FIG. 22 is a graph showing the resistance to crush (Rc) profile of a coreless retail paper roll of group 9.

Now referring to line 168 of FIG. 14, without being bound to theory, it is believed that the particular shape of the line 168 can be partially explained by the presence of small voids containing air being trapped between the layers of paper prior to exerting a load onto the coreless retail paper roll. As force is applied to the roll the Rc increases as shown by segment 170 of line 168. As the force continues to be applied Rc increases to a point where the voids collapse and the Rc briefly decreases as shown by area 172. Thereafter the Rc continues to increase as additional force is applied. As mentioned above, a crush profile was generated for each of the ninety rolls illustrating their enhanced Rc.

It should be appreciated that embodiments of coreless retail paper rolls 50 of the present disclosure can have, for example, various ranges of ID, OD, Rc, and W. For example, coreless rolls of the present disclosure may have an ID that falls within the range of about 0.3 inches to about 1.5 inches. Additional examples include, about 0.4 inches to about 1.4 inches, or about 0.5 inches to about 1.3 inches, or about 0.6 inches to about 1.2 inches, or about 0.7 to about 1.1 inches, or about 0.8 to about 1 inch, or about 0.4 inches to about 0.5 inches or less, or about 0.5 inches to about 0.9 or less, or about 0.5 inches to about 0.9 inches, or about 0.6 inches to about 0.8 inches, or about 0.5 to about 0.7 inches, or about 0.4 inches to about 0.6 inches, or about 0.5 inches to about 0.9 inches, or about 0.5 inches to about 0.875 inches or less, about 0.9 inches to about 1.3 inches, or about 0.8 to about 1.2 inches, or about 0.7 to about 0.9 inches, or about 0.6 to about 0.8 inches, or about 0.5 to about 0.7 inches, or about 0.4 to about 0.6 inches, or about 0.3 to about 0.5 inches, or about 0.2 to about 0.4 inches, or about 0.1 to about 0.3 inches, or about 0.875 inches to about 1.125 inches or less. The ID of the coreless rolls of the present invention can have an ID of any combination of the above ranges, or ranges contained within the above ranges. In addition, the ID of the coreless rolls of the present invention can have any value falling within any of the above described ranges.

It should also be appreciated that a coreless roll of the present disclosure may, for example, have an OD that falls within the range of about 1 to about 4, or about 0.9 inches to about 3.5 inches, or about 0.8 inches to about 3 inches, or about 0.7 inches to about 2.5 inches, or about 0.6 inches to about 2 inches, or about 0.5 inches to about 1.5 inches, or about 0.4 inches to about 1 inch, or about 0.3 inches to about 0.5 inches, or about 0.2 inches to about 0.25 inches, about 1.2 to about 1.7, or about 1.7 to about 2.2, or about 2.2 to about 4, or about 1.5 to about 2, or about 2 to about 2.5, or about 2.5 to about 4, or about 2.2 to about 2.6, or about 2.6 to about 4. The OD of the coreless rolls of the present invention can have an OD of any combination of the above ranges, or ranges contained within the above ranges. In addition, the OD of the coreless rolls of the present invention can have any value falling within any of the above described ranges.

It should further be appreciated that a coreless roll of the present disclosure may have an Rc of 100 lbs/in/in or greater. Examples of Rc values greater than 100 lbs/in/in include about 200 lbs/in/in, about 300 lbs/in/in, about 400 lbs/in/in, about 500 lbs/in/in, about 600 lbs/in/in, about 700 lbs/in/in, about 800 lbs/in/in, about 900 lbs/in/in, about 1000 lbs/in/in, about 1100 lbs/in/in, about 1200 lbs/in/in, about 1300 lbs/in/in, about 1400 lbs/in/in, about 1500 lbs/in/in, about 1600 lbs/in/in, about 1700 lbs/in/in, about 1800 lbs/in/in, about 1900 lbs/in/in, about 2000 lbs/in/in or any value between 100 lbs/in/in and 2000 lbs/in/in. Moreover it should be appreciated that a coreless roll of the present disclosure may have an Rc range of about 200 lbs/in/in to about 1800 lbs/in/in, or about 300 lbs/in/in to about 1600 lbs/in/in, or about 400 lbs/in/in to about 1400 lbs/in/in, or about 300 lbs/in/in to about 1200 lbs/in/in, or about 200 lbs/in/in to about 1000 lbs/in/in, or about 1000 lbs/in/in to about 1400 lbs/in/in, or about 1250 lbs/in/in to about 1750 lbs/in/in, or about 1500 lbs/in/in to about 1900 lbs/in/in, or about 750 lbs/in/in to about 950 lbs/in/in, or about 1150 lbs/in/in to about 1400 lbs/in/in, or about 1350 lbs/in/in to about 1650 lbs/in/in, or about 1100 lbs/in/in to about 1450 lbs/in/in, or about 1150 lbs/in/in to about 1600 lbs/in/in. The Rc of the coreless rolls of the present invention can have an Rc of any combination of the above ranges, or ranges contained within the above ranges. In addition, the Rc of the coreless rolls of the present invention can have any value falling within any of the above described ranges.

Moreover, it should also be appreciated that the concepts of the present disclosure could be used to produce coreless retail paper rolls with even higher Rc values. Indeed, the coreless retail paper rolls of the present disclosure have a resistance to crush (Rc) that not only significantly exceeds the Rc of prior art rolls, but also significantly exceeds the commercial requirements associated with use of the rolls (e.g., resistance to being crushed during shipping and handling). As such, rolls produced with the Rc values shown in FIGS. 14-22 provide a significant commercial advantage over prior art rolls and the methods used to make them. However, if needed for a particular purpose above and beyond current commercial requirements, rolls having significantly higher Rc values than those shown in FIGS. 14-22 could be obtained by use of the concepts described herein. For example, coreless retail paper rolls having an Rc of 5,000 lbs/in/in or even higher are believed possible by utilizing the concepts described herein. As a result, the coreless retail paper rolls 50 described herein may have an Rc in the range 100 to 5,000 lbs/in/in when a force greater than 7 lbs/in is applied to the coreless retail paper roll. However, the specific desired Rc value of a given roll will depend on the requirements of its given commercial application. As shown in FIGS. 14-22, the typical applied forces used to test the Rc of a given sample roll may be in the range of 7 to 80 lbs/in depending on the size of the roll. However, as described above, resistance to crush (Rc) is calculated based on measurements taken only up until when the outer diameter of the coreless retail paper roll has been deflected to 30% of the roll's initial inner diameter.

As indicated above the coreless rolls of the present disclosure are resistant to crush. This is a desirable characteristic for a number of reasons, one being it decreases the number of paper rolls that are crushed during shipment. As such, a greater number of rolls shipped to a retailer are in a condition that allows them to be used in devices such as printers that print point-of-sale (POS) receipts.

It should further be appreciated that the concepts of the present disclosure provide additional commercial advantages over previous rolls and methods of making the same. For instance, a greater length of retail paper may be included on a roll of a given diameter. By way of example, a conventional POS roll produced to an outer diameter of 2.662" and wound around core having an outer diameter of ⅝" includes 230 feet of retail paper. In contrast, by use of the concepts described herein, retail paper having a length of 235.5 feet can be included on a roll that is 2.662" in outer diameter that was produced by wrapping the paper around a rewind arbor having an outer diameter of ⅝". In other words, despite the rolls being of identical size, the rolls produce by the concepts of the present disclosure include 5.5 feet more retail paper than conventional rolls. This equates to an approximate 2.4% increase in the number of transactions per roll. Such an increase in the number of transactions per roll leads to fewer interruptions for roll changes during use thereof by an end user. Moreover, by providing more retail paper per roll, more retail paper is included in each of the boxes, skids, and trucks used to handle the rolls thereby equating to less shipping costs. Similarly, since more retail paper is included in each box (by providing more retail paper on each roll), packaging costs and shipping labor costs are also reduced.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A coreless retail paper roll comprising:

a width of 4 inches or less, an outer diameter range of about 1.7 inch to about 4 inches, and a central hole having an inner diameter range of about 0.8 inches to about 1.2 inch, wherein the coreless retail paper roll has a resistance to crush (Rc) of 350 pounds/inch/inch or greater when a force greater than about 7 pounds/inch is applied to the coreless retail paper roll.

2. The coreless retail paper roll of claim 1, wherein the coreless retail paper roll has a resistance to crust crush (Rc) of 350 pounds/inch/inch or greater when a force greater than about 10 pounds/inch is applied to the coreless retail paper roll.

3. The paper roll of claim 1, wherein the coreless retail paper roll has outer diameter range of about 1.7 to about 2.2 inches.

4. The paper roll of claim 3, wherein the coreless retail paper roll has a resistance to crush (Rc) of 450 pounds/inch/inch or greater.

5. The paper roll of claim 3, wherein the coreless retail paper roll has a resistance to crush (Rc) of 550 pounds/inch/inch or greater.

6. The paper roll of claim 3, wherein the coreless retail paper roll has a resistance to crush (Rc) of 650 pounds/inch/inch or greater.

7. The paper roll of claim 3, wherein the coreless retail paper roll has a resistance to crush (Rc) of 750 pounds/inch/inch or greater.

8. The coreless retail paper roll of claim 1, wherein the coreless retail paper roll has outer diameter range of about 2.2 inches to about 2.6 inches.

9. The paper roll of claim 8, wherein the coreless retail paper roll has a resistance to crush (Rc) of 450 pounds/inch/inch or greater.

10. The paper roll of claim 8, wherein the coreless retail paper roll has a resistance to crush (Rc) of 550 pounds/inch/inch or greater.

11. The paper roll of claim 8, wherein the coreless retail paper roll has a resistance to crush (Rc) of 650 pounds/inch/inch or greater.

12. The paper roll of claim 8, wherein the coreless retail paper roll has a resistance to crush (Rc) of 750 pounds/inch/inch or greater.

13. The paper roll of claim 8, wherein the coreless retail paper roll has a resistance to crush (Rc) of 850 pounds/inch/inch or greater.

14. The paper roll of claim 8, wherein the coreless retail paper roll has a resistance to crush (Rc) of 950 pounds/inch/inch or greater.

15. The paper roll of claim 8, wherein the coreless retail paper roll has a resistance to crush (Rc) of 1050 pounds/inch/inch or greater.

16. The coreless retail paper roll of claim 1, wherein the coreless retail paper roll has outer diameter range of about 2.6 inches to about 4 inches.

17. The paper roll of claim 16, wherein the coreless retail paper roll has a resistance to crush (Rc) of 450 pounds/inch/inch or greater.

18. The paper roll of claim 16, wherein the coreless retail paper roll has a resistance to crush (Rc) of 550 pounds/inch/inch or greater.

19. The paper roll of claim 16, wherein the coreless retail paper roll has a resistance to crush (Rc) of 650 pounds/inch/inch or greater.

20. The paper roll of claim 16, wherein the coreless retail paper roll has a resistance to crush (Rc) of 750 pounds/inch/inch or greater.

21. The paper roll of claim 16, wherein the coreless retail paper roll has a resistance to crush (Rc) of 850 pounds/inch/inch or greater.

22. The paper roll of claim 16, wherein the coreless retail paper roll has a resistance to crush (Rc) of 950 pounds/inch/inch or greater.

23. The paper roll of claim 16, wherein the coreless retail paper roll has a resistance to crush (Rc) of 1050 pounds/inch/inch or greater.

* * * * *